US009180714B2

(12) United States Patent
Ono et al.

(10) Patent No.: US 9,180,714 B2
(45) Date of Patent: Nov. 10, 2015

(54) HEAT-SENSITIVE TRANSFER RECORDING MEDIUM

(71) Applicant: TOPPAN PRINTING CO., LTD., Tokyo (JP)

(72) Inventors: Yasunori Ono, Tokyo (JP); Yasuo Sugishita, Tokyo (JP); Takehito Yamato, Tokyo (JP); Akihiko Ito, Tokyo (JP); Ken Oshinomi, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 69 days.

(21) Appl. No.: 14/346,585

(22) PCT Filed: Sep. 24, 2012

(86) PCT No.: PCT/JP2012/006051

§ 371 (c)(1),
(2) Date: Mar. 21, 2014

(87) PCT Pub. No.: WO2013/046625

PCT Pub. Date: Apr. 4, 2013

(65) Prior Publication Data

US 2014/0232808 A1 Aug. 21, 2014

(30) Foreign Application Priority Data

| | | |
|---|---|---|
| Sep. 27, 2011 | (JP) | 2011-211270 |
| Sep. 27, 2011 | (JP) | 2011-211271 |
| Sep. 27, 2011 | (JP) | 2011-211272 |
| Nov. 30, 2011 | (JP) | 2011-261632 |
| Dec. 5, 2011 | (JP) | 2011-265773 |

(51) Int. Cl.

| | |
|---|---|
| ***B41M 5/382*** | (2006.01) |
| ***B41M 5/385*** | (2006.01) |
| ***B41M 5/44*** | (2006.01) |
| ***B41M 5/392*** | (2006.01) |

(52) U.S. Cl.

CPC ..... *B41M 5/392* (2013.01); *B41M 5/3852* (2013.01); *B41M 5/44* (2013.01); *B41M 5/38214* (2013.01); *B41M 2205/02* (2013.01); *B41M 2205/30* (2013.01); *B41M 2205/34* (2013.01); *B41M 2205/36* (2013.01); *B41M 2205/38* (2013.01)

(58) Field of Classification Search

CPC .. B41M 5/382; B41M 5/38214; B41M 5/385; B41M 5/3852; B41M 5/44; B41M 2205/02; B41M 2205/04; B41M 2205/30; B41M 2205/36; B41M 2205/38

USPC ..... 428/32.64; 503/227

See application file for complete search history.

(56) References Cited

U.S. PATENT DOCUMENTS

| | | | |
|---|---|---|---|
| 5,147,843 | A | 9/1992 | Bodem et al. |
| 2007/0190253 | A1 | 8/2007 | Matsunaga |
| 2008/0069982 | A1 | 3/2008 | Odaka et al. |
| 2008/0274310 | A1 | 11/2008 | Fukui et al. |
| 2009/0130348 | A1 | 5/2009 | Yamashita et al. |
| 2010/0051184 | A1 | 3/2010 | Oguma et al. |

FOREIGN PATENT DOCUMENTS

| | | |
|---|---|---|
| JP | 5-131760 | 5/1993 |
| JP | 2004-351413 | 12/2004 |
| JP | 2005-231354 | 9/2005 |
| JP | 2006-150956 | 6/2006 |
| JP | 2006-244840 | 9/2006 |
| JP | 2006-248057 | 9/2006 |
| JP | 2006-306017 | 11/2006 |
| JP | 2008-155612 | 7/2008 |
| JP | 2009-43712 | 2/2009 |
| JP | 2010-52297 | 3/2010 |
| JP | 2010-58501 | 3/2010 |
| JP | 2011-73172 | 4/2011 |

OTHER PUBLICATIONS

International Search Report mailed Oct. 16, 2012 in corresponding International Patent Application No. PCT/JP2012/006051.

*Primary Examiner* — Bruce H Hess

(57) ABSTRACT

Provided is a heat-sensitive transfer recording medium having a base material, and an undercoating layer and a dye layer sequentially laminated and formed on the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. The dye layer is formed by applying and then drying a dye layer-forming application liquid containing an anthraquinone compound as a thermal migratory dye.

18 Claims, 1 Drawing Sheet

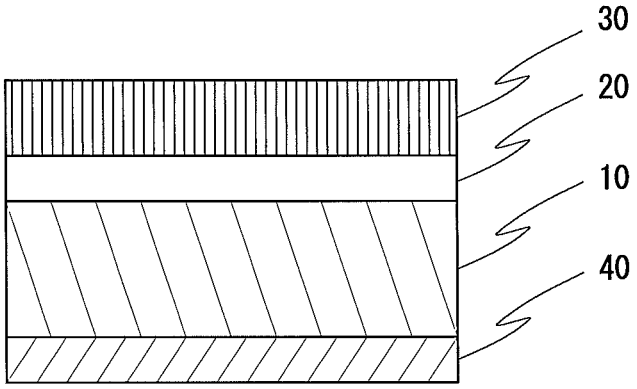
30
20
10
40

HEAT-SENSITIVE TRANSFER RECORDING MEDIUM

CROSS-REFERENCE TO RELATED APPLICATIONS

This application is a U.S. national stage application of PCT/JP2012/006051 filed Sep. 24, 2012 and claims foreign priority benefit of Japanese Patent Applications No. 2011-211270 filed Sep. 27, 2011, No. 2011-211271 filed Sep. 27, 2011, No. 2011-211272 filed Sep. 27, 2011, No. 2011-261632 filed Nov. 30, 2011, and No. 2011-265773 filed Dec. 5, 2011 in the Japanese Intellectual Property Office, the contents of which are incorporated herein by reference.

TECHNICAL FIELD

The present invention relates to a heat-sensitive transfer recording medium used in heat-sensitive transfer type printers.

BACKGROUND ART

Generally, a heat-sensitive transfer recording medium is referred to as a thermal ribbon which is an ink ribbon used in heat-sensitive transfer type printers, and has a heat-sensitive transfer layer on one surface of a base material, and a heat-resistant slippage layer (back coat layer) on the other surface of the base material. Here, the heat-sensitive transfer layer is a layer of ink, and the ink is sublimed (sublimation transfer type) or melted (melt transfer type) by heat generated by a thermal head of a printer to be transferred to a transfer-target object side.

At present, since the sublimation transfer type, among the heat-sensitive transfer types, enables high performance printers to easily form various images in full color, the heat-sensitive transfer type is widely used for do-it-yourself printing for digital cameras, cards such as identification cards, output objects for amusement, etc. In addition to diversification of such use applications, the demands for reduction in size, faster speed, cost reduction, and durability of obtained printed objects have become large. As a result, there has been quite widespread use in recent years of heat-sensitive transfer recording media, having a plurality of heat-sensitive transfer layers with protective layers and the like disposed so as not to overlap, for providing durability to printed objects on the same side of a base material sheet.

Under such circumstances, associated with diversification of use applications and widespread use and as higher printing speed is achieved by printers, a problem arises where sufficient print density cannot be obtained with a conventional heat-sensitive transfer recording medium. Thus, in order to increase transfer sensitivity, attempts have been made for improving transfer sensitivity during printing by reducing the thickness of the heat-sensitive transfer recording medium. However, there are problems such as generation of wrinkles and in some cases generation of fractures due to heat, pressure, etc., when manufacturing the heat-sensitive transfer recording medium or when printing therewith.

In addition, there have been attempts to improve print density and transfer sensitivity during printing by increasing the ratio (dye/binder) of dye with respect to resin in a dye layer of a heat-sensitive transfer recording medium. However, increasing the amount of dye not only increases cost, but also results in so called scumming such as resulting in a hue different from a specified color when, during manufacturing, one part of the dye shifts (set-off) to a heat-resistant slippage layer of a heat-sensitive transfer recording medium in a wind-up state, the shifted dye is, during roll-back thereafter, retransferred (secondary set-off) to a dye layer of another color or to a protective layer, and the tainted layer is thermally transferred to a transfer-target object.

Furthermore, attempts have been made to increase energy on not only the heat-sensitive transfer recording medium side but also on a printer side when forming images. However, not only power consumption increases but the lifespan of a thermal head of the printer becomes shorter, and so-called abnormal transfer of fusing of a dye layer and transfer-target object occur easily. As a response, when a large amount of mold releasing agent is added to a transfer-target object or a dye layer for preventing abnormal transfer, blurring of an image and scumming occurs.

Several methods have been proposed to solve such problems. For example, Patent Literature 1 proposes a thermal transfer sheet including, between a base material and a dye layer, an adhesion layer containing a polyvinyl pyrrolidone resin and a modified polyvinyl pyrrolidone resin.

In addition, Patent Literature 2 proposes a thermal transfer sheet including, between a base material and a dye layer, an adhesion layer including colloidal inorganic pigment ultrafine particles, and a polyvinyl alcohol resin or a polyvinyl pyrrolidone resin which is a thermoplastic resin.

Furthermore, Patent Literature 3 proposes a thermal transfer sheet including, between a base material and a dye layer, a foundation layer including colloidal inorganic pigment ultrafine particles and a vinylpyrrolidone-vinyl acetate copolymer.

Disposing a layer including a specific material between a base material and a dye layer as described above improves transfer sensitivity. As the transfer sensitivity is improved, it becomes possible to reduce the thickness of the dye layer, resulting in reduction in the total amount of the dye and reduction in cost cut. However, there are problems such as generation of wrinkles and in some cases generation of fractures due to heat, pressure, etc., when printing with the heat-sensitive transfer recording medium.

Wrinkles when printing with the heat-sensitive transfer recording medium may occur due to adhesion of the base material and the thermal head when slippage of the heat-resistant slippage layer is insufficient. In addition, if slippage of the heat-resistant slippage layer is largely different between low-energy printing and high-energy printing, in cases such as, for example, when a printed part and an unprinted part coexist on the same image, wrinkles may occur due to a difference in friction between the thermal head and the heat-resistant slippage layer.

In order to solve such problems, for example, Patent Literature 4 proposes a thermal transfer sheet configured to prevent wrinkles to occur during printing by improving slippage during high-energy printing by adding, to the heat-resistant slippage layer, a silicone modified resin, a metallic soap, and a filler component.

Furthermore, an aqueous thermal transfer image-receiving sheet having formed thereon an aqueous-receiving layer tends to have strong adhesivity on a side of the image-receiving sheet, and it is confirmed that the required releasability is different depending on whether high energy is applied (high density) or intermediate energy is applied (intermediate density) during printing from a thermal head.

For a conventional oily image-receiving sheet, since it is sufficient when releasability for high density printing is ensured, the thermal transfer sheets disclosed in, for example, Patent Literature 1 to 3 can handle printing to a certain degree.

However, when an aqueous image-receiving sheet is used, since adhesion tends to occur even for intermediate density printing, a thermal transfer sheet that can sufficiently handle intermediate density to high density printing is necessary.

Thus, Patent Literature 5 proposes a thermal transfer sheet having a dye layer that contains a dye, a resin binder, and a mold releasing agent at a specific amount with respect to the resin binder, and whose water content is adjusted to be 2.5% or lower.

CITATION LIST

Patent Literature

[PTL 1] Japanese Laid-Open Patent Publication No. 2005-231354

[PTL 2] Japanese Laid-Open Patent Publication No. 2006-150956

[PTL 3] Japanese Laid-Open Patent Publication No. 2008-155612

[PTL 4] Japanese Laid-Open Patent Publication No. 2006-306017

[PTL 5] Japanese Laid-Open Patent Publication No. 2010-058501

SUMMARY OF THE INVENTION

Problems to be Solved by the Invention

However, when printing is performed with the heat-sensitive transfer recording medium proposed in Patent Literature 1 in a sublimation transfer type high speed printer, the transfer sensitivity during printing is low and does not reach a sufficient level, and print wrinkles associated with reduction in thickness cannot be prevented from occurring.

Furthermore, when images are formed through thermal transfer using the heat-sensitive transfer recording medium proposed in Patent Literature 1 on a thermal transfer image-receiving sheet having formed thereon an aqueous-receiving layer that contains an aqueous (dissolvable or dispersible in a solvent containing water) binder and a mold releasing agent and that is formed on a base material via an aqueous hallow particle layer containing an aqueous binder and hollow particles; it has not been possible to sufficiently prevent shade unevenness from occurring at a high density part. Furthermore, it has not been possible to sufficiently prevent adhesion between the aqueous-receiving layer and a dye layer from occurring at intermediate to high density parts, and abnormal transfer of the dye layer from occurring at the intermediate density part, both.

On the other hand, when printing is performed in the same manner using the heat-sensitive transfer recording media proposed in Patent Literature 2 and 3; although increase in transfer sensitivity at the high density part is observed when compared to that in Patent Literature 1 because colloidal inorganic pigment ultrafine particles are added, the increase has not reached a sufficiently satisfying level for those using a polyvinyl pyrrolidone resin as an adhesion layer. Furthermore, although those using the polyvinyl alcohol resin as the adhesion layer have high transfer sensitivity reaching a sufficient level, adhesion with a dye layer has been insufficient and abnormal transfer has been observed. In addition, it has not been possible to prevent print wrinkles associated with reduction in thickness from occurring. In addition, colloidal inorganic pigment ultrafine particles are extremely expensive, and usage thereof goes against market demands also in terms of cost.

Furthermore, similar to the heat-sensitive transfer recording medium proposed in Patent Literature 1, also with the heat-sensitive transfer recording media proposed in Patent Literature 2 and 3, when images are formed through thermal transfer on a thermal transfer image-receiving sheet having an aqueous-receiving layer formed thereon, it has not been possible to sufficiently prevent shade unevenness from occurring at a high density part. Furthermore, it has not been possible to sufficiently prevent adhesion between the aqueous-receiving layer and the dye layer from occurring at intermediate to high density parts, and abnormal transfer of the dye layer from occurring at the intermediate density part, both.

When printing is performed using the heat-resistant slippage layer of the heat-sensitive transfer recording medium proposed in Patent Literature 4 as a heat-resistant slippage layer in the heat-sensitive transfer recording media proposed in Patent Literature 1 to 3; although occurrence of print wrinkles has slightly improved when compared to performing printing with each of the heat-sensitive transfer recording media proposed in Patent Literature 1 to 3, it has not been possible to sufficiently prevent print wrinkles from occurring.

In addition, in the thermal transfer sheet proposed in Patent Literature 5 that merely proposes adjusting the added amount of the mold releasing agent and using the resin binder as an adhesion-eased layer; the base material and the binder absorb moisture depending on the environment during usage. Therefore, also when images are formed through thermal transfer using the thermal transfer sheet on a thermal transfer image-receiving sheet having an aqueous-receiving layer formed thereon, it has not been possible to sufficiently prevent adhesion between the aqueous-receiving layer and the dye layer from occurring at intermediate to high density parts, and abnormal transfer of the dye layer from occurring at the intermediate density part, both.

Thus, in view of the above described problems, objects of the present invention is to:

(I) provide a heat-sensitive transfer recording medium that has high transfer sensitivity during high-speed printing, more specifically, that has a large cost-cutting effect through reduction of dye used in a dye layer, and that can prevent abnormal transfer during printing;

(II) provide a heat-sensitive transfer recording medium that has high transfer sensitivity during high-speed printing, more specifically, that has a large cost-cutting effect through reduction of dye used in a dye layer, and that can sufficiently prevent abnormal transfer during printing and print wrinkles which occur due to influences such as heat and pressure;

(III) provide a heat-sensitive transfer recording medium that has high transfer sensitivity during high-speed printing, more specifically, that has a large cost-cutting effect through reduction of dye used in a dye layer, that can prevent abnormal transfer during printing, and that can improve shade unevenness occurring at a high density part when images are formed through thermal transfer on a thermal transfer image-receiving sheet having an aqueous-receiving layer formed thereon;

(IV) provide a heat-sensitive transfer recording medium that has high transfer sensitivity during high-speed printing both at a low density part and a high density part, more specifically, that has a large cost-cutting effect through reduction of dye used in a dye layer, and that can prevent abnormal transfer during printing and wrinkles occurring due to influences such as heat and pressure generated during printing; and (V) provide a heat-sensitive transfer recording medium that has high transfer sensitivity during high-speed printing, more specifically, that has a large cost-cutting effect through reduction of dye used in a dye layer, and that can improve adhesion between the aqueous-receiving layer and the dye layer, occurring at intermediate to high density parts, and abnormal transfer of the dye layer, occurring at the intermediate density part, both, when images are formed through thermal transfer on a thermal transfer image-receiving sheet having an aqueous-receiving layer formed thereon.

Solution to the Problems (I) A heat-sensitive transfer recording medium according to the present invention includes a base material, and an undercoating layer and a dye layer sequentially laminated and formed on the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. The dye layer is formed by applying and then drying a dye layer-forming application liquid containing an anthraquinone compound as a thermal migratory dye. Hereinafter, this heat-sensitive transfer recording medium is referred to as "a heat-sensitive transfer recording medium I."

Preferably in the heat-sensitive transfer recording medium I according to the present invention, a content ratio of the polyvinyl alcohol and the polyvinyl pyrrolidone in the undercoating layer on mass basis is polyvinyl alcohol/polyvinyl pyrrolidone=4/6 to 7/3.

Preferably in the heat-sensitive transfer recording medium I according to the present invention, an applied amount of the undercoating layer after drying, represented by an amount of solid content remaining after the undercoating layer-forming application liquid is applied and dried, is 0.05 to 0.30 g/m$^2$.

(II) A heat-sensitive transfer recording medium according to the present invention includes a base material, a heat-resistant slippage layer formed on one surface of the base material, and an undercoating layer and a dye layer sequentially laminated and formed on the other surface of the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. The dye layer is formed by applying and then drying a dye layer-forming application liquid containing an anthraquinone compound as a thermal migratory dye. An average value $\alpha$ of surface roughness Ra of the heat-resistant slippage layer is 0.05 to 0.50 μm, and an average value $\beta$ of surface roughness Ra of the heat-resistant slippage layer after being left still at 150° C. for 10 minutes is 0.00 to 0.80 μm. A difference between the average value $\alpha$ and the average value $\beta$ is 0.00 to 0.30 μm. Hereinafter, this heat-sensitive transfer recording medium is referred to as "a heat-sensitive transfer recording medium II."

Preferably in the heat-sensitive transfer recording medium II according to the present invention, a content ratio of the polyvinyl alcohol and the polyvinyl pyrrolidone in the undercoating layer on mass basis is polyvinyl alcohol/polyvinyl pyrrolidone=4/6 to 7/3.

Preferably in the heat-sensitive transfer recording medium II according to the present invention, an applied amount of the undercoating layer after drying, represented by an amount of solid content remaining after the undercoating layer-forming application liquid is applied and dried, is 0.05 to 0.30 g/m$^2$.

(III) A heat-sensitive transfer recording medium according to the present invention is for forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles. The heat-sensitive transfer recording medium includes a base material, and an undercoating layer and a dye layer sequentially laminated and formed on the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. The dye layer is formed by applying and then drying a dye layer-forming application liquid containing filler particles and an anthraquinone compound as a thermal migratory dye. A three-dimensional surface roughness (SRa) of the dye layer is 0.15 to 0.70 μm. Hereinafter, this heat-sensitive transfer recording medium is referred to as "a heat-sensitive transfer recording medium III."

Preferably in the heat-sensitive transfer recording medium III according to the present invention, a content ratio of the polyvinyl alcohol and the polyvinyl pyrrolidone in the undercoating layer on mass basis is polyvinyl alcohol/polyvinyl pyrrolidone=4/6 to 7/3.

Preferably in the heat-sensitive transfer recording medium III according to the present invention, an applied amount of the undercoating layer after drying, represented by an amount of solid content remaining after the undercoating layer-forming application liquid is applied and dried, is 0.05 to 0.30 g/m$^2$.

Preferably in the heat-sensitive transfer recording medium III according to the present invention, a volume average particle diameter of the filler particles is 0.1 to 3.0 μm.

(IV) A heat-sensitive transfer recording medium according to the present invention includes a base material, and an undercoating layer and a dye layer sequentially laminated and formed on the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. The dye layer is formed by applying and then drying a dye layer-forming application liquid containing an anthraquinone compound as a thermal migratory dye, and, as resin binders, polyvinyl acetal whose glass transition temperature is not lower than 100° C. and polyvinyl butyral whose glass transition temperature is not higher than 75° C. Hereinafter, this heat-sensitive transfer recording medium is referred to as "a heat-sensitive transfer recording medium IV."

Preferably in the heat-sensitive transfer recording medium IV according to the present invention, a content ratio of the polyvinyl alcohol and the polyvinyl pyrrolidone in the undercoating layer on mass basis is polyvinyl alcohol/polyvinyl pyrrolidone=4/6 to 7/3.

Preferably in the heat-sensitive transfer recording medium IV according to the present invention, an applied amount of the undercoating layer after drying, represented by an amount of solid content remaining after the undercoating layer-forming application liquid is applied and dried, is 0.05 to 0.30 g/m$^2$.

Preferably in the heat-sensitive transfer recording medium IV according to the present invention, a content ratio of the polyvinyl acetal whose glass transition temperature is not lower than 100° C. and the polyvinyl butyral whose glass transition temperature is not higher than 75° C. in the dye layer on mass basis is polyvinyl acetal/polyvinyl butyral=50/50 to 97/3.

(V) A heat-sensitive transfer recording medium according to the present invention is for forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles. The heat-sensitive transfer recording medium includes a base material, and an undercoating layer and dye layers sequentially laminated and formed on the base material. The undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$. At least one of the dye layers is formed by applying and then drying a dye layer-forming application liquid containing at least two types of modified silicone oils as mold releasing agents, and an anthraquinone compound as a thermal migratory dye. The modified silicone oils include a nonreactive silicone oil whose number average molecular weight is not smaller than 8000, and a reactive silicone oil whose number average molecular weight is not larger than 3000. Hereinafter, this heat-sensitive transfer recording medium is referred to as "a heat-sensitive transfer recording medium V."

Preferably in the heat-sensitive transfer recording medium V according to the present invention, a content ratio of the polyvinyl alcohol and the polyvinyl pyrrolidone in the undercoating layer on mass basis is polyvinyl alcohol/polyvinyl pyrrolidone=4/6 to 7/3.

Preferably in the heat-sensitive transfer recording medium V according to the present invention, an applied amount of the undercoating layer after drying, represented by an amount of solid content remaining after the undercoating layer-forming application liquid is applied and dried, is 0.05 to 0.30 g/m$^2$.

Preferably in the heat-sensitive transfer recording medium V according to the present invention, the nonreactive silicone oil is a side-chain polyether modified silicone oil, and the reactive silicone oil is a side-chain diamine modified silicone oil.

Advantageous Effects of the Invention

The heat-sensitive transfer recording medium I of the present invention has high transfer sensitivity during high-speed printing, more specifically, has a large cost-cutting effect through reduction of dye used in a dye layer, and can prevent abnormal transfer during printing.

The present invention of the heat-sensitive transfer recording medium II has high transfer sensitivity during high-speed printing, more specifically, has a large cost-cutting effect through reduction of dye used in a dye layer, and can sufficiently prevent abnormal transfer during printing and print wrinkles which occur due to influences such as heat and pressure.

The heat-sensitive transfer recording medium III of the present invention has high transfer sensitivity during high-speed printing, more specifically, has a large cost-cutting effect through reduction of dye used in a dye layer, and can prevent abnormal transfer during printing. Furthermore, when forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles; it is possible to improve poor image quality generated at the high density part, more specifically, to improve a phenomenon in which hue variation occurs due to the aqueous-receiving layer of the thermal transfer image-receiving sheet, which is a transfer-target object, being fused to the heat-sensitive transfer recording medium to generated shade unevenness on a surface of a printed object.

The heat-sensitive transfer recording medium IV of the present invention has high transfer sensitivity during high-speed printing both at a low density part and a high density part, has a large cost-cutting effect through reduction of dye used in a dye layer, and can prevent abnormal transfer during printing and wrinkles occurring due to influences such as heat and pressure generated during printing.

The heat-sensitive transfer recording medium V of the present invention has high transfer sensitivity during high-speed printing, more specifically, has a large cost-cutting effect through reduction of dye used in a dye layer. Furthermore, when forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles; it is possible to improve adhesion between the aqueous-receiving layer and the dye layer, occurring at intermediate to high density parts, and abnormal transfer of the dye layer, occurring at the intermediate density part, both.

BRIEF DESCRIPTION OF THE DRAWINGS

FIG. 1 is a sectional side view of a heat-sensitive transfer recording medium according to an embodiment based on the present invention.

DESCRIPTION OF EMBODIMENTS

As shown in FIG. 1, a heat-sensitive transfer recording medium of one Example of the present invention has a heat-resistant slippage layer 40 formed on one surface of a base material 10 for providing slipping ability with respect to a thermal head, and an undercoating layer 20 and a dye layer 30 sequentially formed on the other surface of the base material 10. It should be noted that the heat-sensitive transfer recording media I to V of the present invention all have, for example, a configuration shown in FIG. 1.

Embodiment I

Heat-Sensitive Transfer Recording Medium I

For the base material 10, it is necessary to have strength and heat resistance for preventing softening deformation due to heat and pressure during thermal transfer. Examples of base material 10 include films of synthetic resins such as polyethylene terephthalate, polyethylene naphthalate, polypropylene, cellophane, acetate, polycarbonate, polysulfone, polyimide, polyvinyl alcohol, aromatic polyamide, aramid, and polystyrene, and papers such as condenser papers and paraffin papers. With regard to those described above, a single type may be used by itself, or a complex obtained by combining two or more types may be used. Among those described above, a polyethylene terephthalate film is preferable when considering physical-property aspect, processability, and cost aspect etc. Furthermore, for the thickness, although it is possible to use one that has a thickness of not smaller than 2 μm but not larger than 50 μm when operability and processability are taken into consideration, one that has a thickness of about not smaller than 2 μm but not larger than 9 μm is preferable when handleability such as transfer suitability and processability are taken into consideration.

In addition, on the base material 10, it is possible to provide an adhesion treatment on the surface where the heat-resistant slippage layer 40 and/or the undercoating layer 20 are/is formed. As the adhesion treatment, technologies known in the art can be applied, such as corona treatment, flame treatment, ozone treatment, ultraviolet ray treatment, radiation treatment, surface roughening treatment, plasma treatment, and primer treatment. With regard to those treatments, two or more types can be used in combination. In the present invention, a polyethylene terephthalate film that has been primer treated is preferably used because of the cost and since it is effective to increase adhesiveness between the base material and the undercoating layer.

As the heat-resistant slippage layer 40, those known in the art known can be used, and the heat-resistant slippage layer 40 can be formed by, for example, applying and then drying a heat-resistant slippage layer-forming application liquid prepared by blending a resin that acts as a binder, a functional additive that provides releasability and slipping ability, a bulking agent, a filler, a curing agent, a solvent, and the like. The applied amount of the heat-resistant slippage layer 40 after drying is not particularly limited, and an amount not less than 0.1 g/m$^2$ but not more than 2.0 g/m$^2$ is appropriate.

Here, the applied amount of the heat-resistant slippage layer 40 after drying refers to the amount of solid content remaining after the heat-resistant slippage layer-forming application liquid is applied and dried. Similarly, the applied amount of the undercoating layer 20 after drying and the applied amount of the dye layer 30 after drying described later refer to the amount of solid content remaining after applying and drying an undercoating layer-forming application liquid and a dye layer-forming application liquid described later, respectively.

Example of the heat-resistant slippage layer as a binder resin include polyvinyl butyral resins, polyvinyl acetoacetal resins, polyester resins, vinyl chloride-vinyl acetate copolymers, polyether resins, polybutadiene resins, acrylic polyols, polyurethane acrylates, polyester acrylates, polyether acrylates, epoxy acrylates, nitrocellulose resins, cellulose acetate resins, polyamide resins, polyimide resins, polyamide imide resins, polycarbonate resins, polyacrylic resins, and modified objects thereof.

The undercoating layer 20 is formed by applying and then drying an undercoating layer-forming application liquid containing polyvinyl pyrrolidone and polyvinyl alcohol whose tensile strength measured based on a method described in JIS K 7113 "Testing method for tensile properties of plastics" is not lower than 8 kg/mm$^2$.

As the polyvinyl alcohol, it is essential to have a tensile strength not lower than 8 kg/mm$^2$ measured based on JIS K 7113. When the tensile strength is lower than 8 kg/mm$^2$, it is difficult to provide high transfer sensitivity during printing. Examples of the polyvinyl alcohol whose tensile strength is not lower than 8 kg/mm$^2$ include Kuraray Poval PVA-124 (manufactured by Kuraray (K.K.)) and Kuraray Poval PVA-145 (manufactured by Kuraray (K.K.)).

The polyvinyl alcohol may be prepared with a common method such as polymerizing vinyl acetate in methanol to obtain a methanol solution of polyvinyl acetate, saponifying the methanol solution using sodium hydroxide or the like, and neutralizing the obtained saponified product. The degree of saponification and average degree of polymerization of the obtained polyvinyl alcohol is not particularly limited as long as the tensile strength measured based on JIS K 7113 is not lower than 8 kg/mm$^2$ as described above, and polyvinyl alcohol having, for example, a degree of saponification of about 90 to 99 mol % and an average degree of polymerization of about 2000 to 4500 can be suitably used.

Examples of the polyvinyl pyrrolidone include a single polymer (homopolymer) of vinylpyrrolidone such as N-vinyl-2-pyrrolidone and N-vinyl-4-pyrrolidone, and a copolymer thereof. Examples thereof also include modified polyvinyl pyrrolidone resins. A modified polyvinyl pyrrolidone resin is a copolymer of an N-vinylpyrrolidone-based monomer and another monomer. It should be noted that the copolymerization form is not particularly limited and may be random copolymerization, block copolymerization, graft copolymerization, and the like. The N-vinylpyrrolidone-based monomer refers to N-vinylpyrrolidone (N-vinyl-2-pyrrolidone, N-vinyl-4-pyrrolidone, etc.) and derivatives thereof, and examples of the derivatives include those having a substituent group on a pyrrolidone ring, such as N-vinyl-3-methyl pyrrolidone, N-vinyl-5-methylpyrrolidone, N-vinyl-3,3,5-trimethyl pyrrolidone, N-vinyl-3-benzyl pyrrolidone, and the like.

Examples of the monomer component that is to be copolymerized with the N-vinylpyrrolidone-based monomer include a vinyl polymerization monomer as described below. Examples thereof include (meta)acrylic monomers such as (meta)acrylic acid, methyl(meta)acrylate, ethyl(meta)acrylate, and isopropyl(meta)acrylate, unsaturated carboxylic acids such as fumaric acid, maleic acid, and itaconic acid, ethylene, propylene, vinyl chloride, vinyl acetate, vinyl alcohol, styrene, vinyltoluene, divinylbenzene, vinylidene chloride, tetrafluoroethylene, and vinylidene fluoride.

The content ratio of the polyvinyl alcohol and the polyvinyl pyrrolidone in the undercoating layer 20 on mass basis is preferably polyvinyl alcohol/polyvinyl pyrrolidone=4/6 to 7/3, and further preferably 5/5 to 6/4. Although polyvinyl alcohol has excellent dye barrier performance among water soluble polymer compounds, when polyvinyl alcohol alone is laminated, adhesion with the dye layer becomes insufficient and abnormal transfer may occur. On the other hand, although polyvinyl alcohol has inferior dye barrier property when compared to polyvinyl pyrrolidone, polyvinyl pyrrolidone is very adhesive with respect to the dye layer, and the above described content ratio can sufficiently satisfy both high transfer sensitivity and prevention of abnormal transfer.

Although the applied amount of the undercoating layer 20 after drying cannot be limited unconditionally, the applied amount is preferably within a range not less than 0.05 g/m$^2$ but not more than 0.30 g/m$^2$, and further preferably within a range not less than 0.10 g/m$^2$ but not more than 0.20 g/m$^2$. When the applied amount is less than 0.05 g/m$^2$, transfer sensitivity during high-speed printing becomes insufficient due to deterioration of lamination of the dye layer, and adhesion with the base material or the dye layer may deteriorate. On the other hand, when the applied amount is more than 0.30 g/m$^2$, sensitivity of the heat-sensitive transfer recording medium I itself becomes affected and transfer sensitivity during high-speed printing may deteriorate.

To the undercoating layer, as long as performance thereof is not compromised, it is possible to use an additive known in the art such as inorganic pigment fine particles, isocyanate compounds, silane coupling agents, dispersants, viscosity modifiers, and stabilizing agents.

The dye layer 30 is formed by applying and then drying a dye layer-forming application liquid prepared by, for example, blending, other than a thermal migratory dye a binder, a solvent, and the like. It should be noted that the dye layer can be formed with a monolayer of a single color, or a plurality of dye layers containing dyes with different hues can be field-sequentially formed in a repeating manner on a single surface of a single base material.

The thermal migratory dye used in the dye layer 30 is a dye that melts, diffuses, or sublimates to migrate, with heat. Examples of yellow components include Solvent yellow 56, 16, 30, 93, and 33, or Disperse yellow 201, 231, 33, or the like. Examples of magenta components include C. I. Disperse red 60, C. I. Disperse violet 26, C. I. Disperse violet 38, C. I. Solvent red 27, C. I. Solvent red 19, or the like. Among those described above, it is essential to use, as the thermal migratory dye, an anthraquinone compound represented by C. I. Disperse violet 38 and the like in the present invention. Examples of cyan components include C. I. Disperse blue 354, C. I. Solvent blue 63, C. I. Solvent blue 36, C. I. Solvent blue 266, C. I. Disperse blue 257, C. I. Disperse blue 24, or the like. Among those described above, it is essential to use, as the thermal migratory dye, an anthraquinone compound represented by C. I. Solvent blue 63, C. I. Solvent blue 36, C. I. Disperse blue 24, or the like in the present invention. The reason is because, when the undercoating layer is introduced between the base material and the dye layer, a dye consisting of the anthraquinone compound is superior in transfer efficiency to an image-receiving layer than other dyes, and it becomes possible to provide high transfer sensitivity, i.e., reduce the amount of dye used in the dye layer.

The binder contained in the dye layer 30 is not particularly limited and any hitherto known resin binder can be used, and examples thereof include cellulose-based resins such as ethyl cellulose, hydroxyethyl cellulose, ethylhydroxy cellulose, hydroxypropyl cellulose, and cellulose acetate, vinyl-based resins such as polyvinyl alcohol, polyvinyl acetate, polyvinyl acetal, polyvinyl pyrrolidone, and polyacrylamide, polyester resins, styrene-acrylonitrile copolymer resins, phenoxy resins, and the like.

Here, the blend ratio of the thermal migratory dye and the binder on mass basis when forming the dye layer 30 is preferably thermal migratory dye/binder=10/100 to 300/100. This is because, when the blend ratio of thermal migratory dye/binder is lower than 10/100, coloring sensitivity becomes insufficient due to the amount of dye being too small, and excellent thermal transfer images cannot be obtained. In addition, when the blend ratio is higher than 300/100, solubility of the dye with respect to the binder decreases extremely, and preservation stability of the obtained heat-sensitive transfer recording medium I deteriorates and the dye may easily precipitate.

Furthermore, the dye layer may contain, as long as performance thereof is not compromised, an additive known in the art such as dispersants, viscosity modifiers, and stabilizing agents.

Although the applied amount of the dye layer 30 after drying cannot be limited unconditionally; from a standpoint of preventing abnormal transfer and wrinkles from occurring during printing, and preventing an increase in cost, an applied amount not less than 0.3 $g/m^2$ but not more than 1.5 $g/m^2$ is appropriate.

It should be noted that the heat-resistant slippage layer 40, the undercoating layer 20, and the dye layer 30 can all be formed by respectively applying and then drying a heat-resistant slippage layer-forming application liquid, an undercoating layer-forming application liquid, and a dye layer-forming application liquid using a hitherto known application method. Examples of the application method include a gravure coating, screen printing, spray coating, and reverse roll coating.

Embodiment II

Heat-Sensitive Transfer Recording Medium II

A base material 10 similar to the base material 10 included in the heat-sensitive transfer recording medium I can be used. In addition, on the base material 10, it is possible to provide an adhesion treatment on the surface where a heat-resistant slippage layer 40 and/or an undercoating layer 20 and/is formed, similarly to the heat-sensitive transfer recording medium I.

An average value $\alpha$ of surface roughness Ra of the heat-resistant slippage layer 40 is 0.05 to 0.50 μm, an average value $\beta$ of surface roughness Ra of the heat-resistant slippage layer 40 after being left still at 150° C. for 10 minutes is 0.00 to 0.80 μm, and the difference between the average value $\alpha$ and the average value $\beta$ is 0.00 to 0.30 μm.

Surface roughness Ra can be measured with various methods such as common contact-type methods and non-contact type methods. However, in the present invention, a measuring method using laser microscopy, which is a non-contact type measuring method, was adopted since the method is unlikely to be affected by a foundation, and it is possible to measure minute shapes. As a measuring device, a scanning confocal laser microscope "OLS1100" manufactured by Olympus (K.K.) was used. Since the resolution depends on the numerical aperture of objective lens when measuring with laser microscopy, a 100× objective lens having the largest numerical aperture was selected. A measured image was divided into eleven in the Y-axis direction, and measurements of Ra value were each performed at a position that became a boundary with the division, using a cutoff value of ⅓ in the X-axis direction. Ra values from the obtained ten points were averaged to obtain an Ra value of the heat-resistant slippage layer. The average value $\alpha$ is a value obtained before the heat-resistant slippage layer is left still at 150° C. for 10 minutes, and the average value $\beta$ is a value obtained after the heat-resistant slippage layer is left still with that condition.

Poor printing can be prevented, since the heat-resistant slippage layer 40 has certain level of concavities and convexities resulting in reduced contact surface size between the heat-resistant slippage layer 40 and the thermal head, and slippage is obtained due to reduced friction therebetween. Thus, when the average value $\alpha$ of surface roughness Ra of the heat-resistant slippage layer 40 is smaller than 0.05 μm, a near-flat condition is obtained, and friction between the heat-resistant slippage layer 40 and the thermal head increases, causing poor printing. However, when the average value $\alpha$ of surface roughness Ra of the heat-resistant slippage layer 40 is larger than 0.50 μm, concavities and convexities becomes too large, and unevenness of how heat is transferred from the thermal head occurs, leading to density unevenness on a printed object. The average value $\alpha$ is preferably 0.10 to 0.40 μm.

In addition, when the average value $\beta$ of surface roughness Ra of the heat-resistant slippage layer 40 after being left still at 150° C. for 10 minutes is larger than 0.80 μm, concavities and convexities increase due to heat, and unevenness of how heat is transferred from the thermal head occurs, leading to density unevenness on also a printed object. It should be noted that the average value $\beta$ is preferably 0.10 to 0.60 μm.

If it is possible to maintain constant concavities and convexities in low to higher energy printing, stable slippage can be obtained in low to higher energy printing even when a printed part and an un-printed part coexist on the same image, difference in slippage of the two parts do not occur, and print wrinkles can be prevented from occurring. When the heat-resistant slippage layer 40 is left still at 150° C. for 10 minutes, the difference in average values of surface roughness Ra before and after, i.e., the difference between the average value α and the average value β, becomes 0.00 to 0.30 μm, large difference in concavities and convexities on the surface does not occur between low-energy printing and high-energy printing, and print wrinkles can be sufficiently prevented from occurring. When the difference between the average value α and the average value β is larger than 0.30 μm, friction and slippage with respect to the thermal head become different, and print wrinkles cannot be prevented from occurring. It is necessary to adjust the concavities and convexities of the heat-resistant slippage layer 40 in order to have the surface roughness to be in the above described range. The difference between the average value α and the average value β is preferably 0.00 to 0.25 μm.

The heat-resistant slippage layer 40 can be formed by, for example, applying and then drying a heat-resistant slippage layer-forming application liquid prepared by blending, to a binder resin, various functional additives and the like, and it is particularly preferable to blend in inorganic particles. By blending in the inorganic particles, concavities and convexities are formed on the surface of the heat-resistant slippage layer 40 and contact surface size with the thermal head becomes small, resulting in reduced friction with the thermal head and improved slippage. Since the inorganic particles change little with heat, certain level of concavities and convexities are maintained even when printing is performed with high energy, and certain level of slippage is observed in low to higher energy printing. Thus, stable heat resistance can be obtained, and wrinkles during printing can be sufficiently prevented from occurring. In addition, by blending in the inorganic particles, it is possible to provide cleanability to the thermal head.

Two or more types of inorganic particles having different mean particle diameters may be used in combination for the purpose of adjusting concavities and convexities of the heat-resistant slippage layer 40, and the combination can be selected as appropriate. The mean particle diameter of the inorganic particle is different depending on the thickness etc., of the formed heat-resistant slippage layer 40 and is not particularly limited. However, the mean particle diameter is preferably 0.1 to 6.0 μm, and more preferably 0.5 to 4.0 μm. When the mean particle diameter of the inorganic particles is smaller than 0.1 μm, the inorganic particles becomes embedded in the heat-resistant slippage layer 40 and cannot form concavities and convexities, and it may not be possible to reduce friction with the thermal head, and cleanability of the thermal head may deteriorate. On the other hand, when the mean particle diameter of the inorganic particles is larger than 6.0 μm, the concavities and convexities of the heat-resistant slippage layer 40 become too large, heat will not be sufficiently conveyed from the thermal head at some locations, possibly resulting in unevenness appearing on a printed, and scratches may occur on a print surface due to object being detached from the heat-resistant slippage layer 40, etc.

Examples of inorganic particle that can be used in the heat-resistant slippage layer 40 include silica particles, magnesium oxide, zinc oxide, calcium carbonate, magnesium carbonate, talc, kaolin, clay, and the like.

The contained amount of the inorganic particles in the heat-resistant slippage layer-forming application liquid is preferably 2 to 30 mass %, and more preferably 3 to 20 mass %. When the contained amount of the inorganic particles is less than 2 mass %, cleaning effect of the thermal head becomes insufficient and the value of surface roughness Ra becomes small. On the other hand, when the contained amount of the inorganic particles is more than 30 mass %, film strength of the heat-resistant slippage layer 40 itself may deteriorate depending on the type of the inorganic particles, and inferior printed objects may be generated due to uneven heat transfer during printing because of having a large surface roughness Ra value.

A lubricant for improving slippage with the thermal head is preferably blended in the heat-resistant slippage layer 40, and two or more types of lubricants having different melting points may be combined and blended. Blending in a lubricant has an advantageous effect of relieving stress to the heat-sensitive transfer recording medium II due to heat, since the lubricant is eluted when heat from the thermal head is applied to the heat-sensitive transfer recording medium to improve slippage. Furthermore, when lubricants having different melting points are blended in, it becomes possible to provide constant slippage in all temperatures from a low temperature to a high temperature, i.e., during low to higher energy printing.

Examples of lubricants that can be used for the heat-resistant slippage layer 40 include natural waxes such as animal waxes and plant waxes, synthetic waxes such as synthetic hydrocarbon waxes, aliphatic alcohol and acidic waxes, fatty acid ester and glycerite waxes, synthetic ketone waxes, amine and amide waxes, chlorinated hydrocarbon waxes, and alpha olefin waxes, and surfactants such as esters of higher fatty acids such as butyl stearate and ethyl oleate, metal salts of higher fatty acids such as sodium stearate, zinc stearate, calcium stearate, potassium stearate, and magnesium stearate, and phosphate esters such as long chain alkyl phosphoric acid esters, polyoxyalkylene alkyl aryl ether phosphate esters, or polyoxyalkylene alkyl ether phosphate esters.

The contained amount of the lubricant in the heat-resistant slippage layer-forming application liquid is preferably 5 to 25 mass %, and more preferably 5 to 15 mass %. When the contained amount of the lubricant is less than 5 mass %, slippage may not be sufficient, or an image may, depending on the image, adhere to the thermal head due to shortage of the lubricant. On the other hand, when the contained amount of the lubricant is more than 25 mass %, slippage is provided more than necessary, and the printing may be affected due to elution of the lubricant.

Examples of binder resins that can be used in the heat-resistant slippage layer 40 include a binder resin similar to that used in the heat-sensitive transfer recording medium I.

In addition, a crosslinking agent for improving heat resistance may be blended in the heat-resistant slippage layer 40. When the crosslinking agent is blended in, heat resistance of the heat-resistant slippage layer 40 improves, and deformation of the base material due to friction with the thermal head can be prevented. Examples of the crosslinking agent include polyisocyanates, which can be used in combination with an acryl-based, urethane-based, or polyester-based polyol resin, a cellulose-based resin, or an acetal resin.

Although the applied amount of the heat-resistant slippage layer 40 after drying cannot be limited unconditionally, the applied amount is preferably within a range not less than 0.2 $g/m^2$ but not more than 2.6 $g/m^2$, and further preferably within a range not less than 0.6 $g/m^2$ but not more than 1.6 $g/m^2$. When the applied amount is less than 0.2 $g/m^2$, heat resistance is low, and thermal contraction occurs easily during printing. On the other hand, when applied amount is more than 2.6 $g/m^2$, heat is not sufficiently transferred to the dye layer 30 from the thermal head and it becomes difficult to obtain a printed object with desired density.

Here, the applied amount of the heat-resistant slippage layer 40 after drying refers to the amount of solid content remaining after the heat-resistant slippage layer-forming application liquid is applied and dried. Similarly, the applied amount of the undercoating layer 20 after drying and the applied amount of the dye layer 30 after drying described later refer to the amount of solid content remaining after applying and drying an undercoating layer-forming application liquid and a dye layer-forming application liquid, respectively, described later.

An undercoating layer 20 can be formed in a manner similar to the undercoating layer 20 in the heat-sensitive transfer recording medium I.

A dye layer 30 can also be formed in a manner similar to the dye layer 30 in the heat-sensitive transfer recording medium I.

It should be noted that the heat-resistant slippage layer 40, the undercoating layer 20, and the dye layer 30 can all be formed in a manner similar to the heat-sensitive transfer recording medium I using hitherto known methods.

Embodiment III

Heat-Sensitive Transfer Recording Medium III

A base material 10 similar to the base material 10 included in the heat-sensitive transfer recording medium I can be used. In addition, on the base material 10, it is possible to provide an adhesion treatment on the surface of a heat-resistant slippage layer 40 and/or an undercoating layer 20 and/is formed, similarly to the heat-sensitive transfer recording medium I.

The heat-resistant slippage layer 40 can be formed in a manner similar to the heat-resistant slippage layer 40 in the heat-sensitive transfer recording medium I.

Here, the applied amount of the heat-resistant slippage layer 40 after drying refers to the amount of solid content remaining after the heat-resistant slippage layer-forming application liquid is applied and dried. Similarly, the applied amount of the undercoating layer 20 after drying and the applied amount of a dye layer 30 after drying described later refer to the amount of solid content remaining after applying and drying an undercoating layer-forming application liquid and a dye layer-forming application liquid, respectively, described later. Similarly, the applied amount of the aqueous hallow particle layer after drying and the applied amount of the aqueous-receiving layer after drying described later also refer to the amount of solid content remaining after applying and drying an aqueous hollow particle layer-forming application liquid and an aqueous-receiving layer-forming application liquid, respectively, described later.

The undercoating layer 20 can be formed in a manner similar to the undercoating layer 20 in the heat-sensitive transfer recording medium I.

The dye layer 30 is formed by applying and then drying a dye layer-forming application liquid prepared by, for example, blending, other than filler particles and a thermal migratory dye, a binder, a solvent, and the like. It should be noted that the dye layer can be formed with a monolayer of a single color, or a plurality of dye layers containing dyes with different hues can be field-sequentially formed in a repeating manner on a single surface of a single base material.

The filler particles are not particularly limited, and those known in the art can be used such as synthetic resin particles and inorganic fine particles. Although the volume average particle diameter of the filler particles is not particularly in limited, when considering the applied amount of the dye layer 30 after drying is preferably about 0.7 to 1.0 g/m$^2$ as described later, the volume average particle diameter is preferably in a range not smaller than 0.1 μm but not larger than 3.0 μm, and further preferably in a range not smaller than 0.5 μm but not larger than 2.0 μm. When the volume average particle diameter is smaller than 0.1 μm, it is difficult to obtain the necessary concavities and convexities of the dye layer in the filler particles; and when filler particles whose volume average particle diameter is larger than 3.0 μm are used, the filler particles may easily slip and drop off the dye layer and print density may deteriorate.

When the filler particles are used, concavities and convexities are produced on the surface of the dye layer, and it becomes possible to prevent thermal fusion bonding of the aqueous-receiving layer and the heat-sensitive transfer recording medium in the thermal transfer image-receiving sheet during printing. As a result, shade unevenness at the high density part can be prevented for occurring. It is essential to have the three-dimensional surface roughness (SRa) of the dye layer is in a range not smaller than 0.15 μm but not larger than 0.70 μm, preferably in a range not smaller than 0.30 μm but not larger than 0.60 μm. When the SRa is smaller than 0.15 μm, the surface of the dye layer becomes too flat and the risk of thermal fusion bonding to occur and shade unevenness to occur at the high density part during printing becomes extremely high. On the other hand, when the SRa is larger than 0.70 μm, although thermal fusion bonding will not occur during printing, transfer sensitivity may deteriorate, and, if the added amount of the filler particles is too much, film strength of the dye layer deteriorates, and the risk of abnormal transfer becomes extremely high.

Examples of synthetic resin particles that can be used include acrylic resin fine particles, silicone resin fine particles, fine particles of organic polymer compounds obtained through emulsion polymerization of vinyl monomer, fine particles of organic polymer compounds obtained through polycondensation of polyester, polyamide, polyimide, polybenzoxazole, and the like, and fine particles of organic polymer compounds obtained through addition condensation of phenol resins, melamine resins, and the like. Among those described above, silicone resin fine particles are preferred.

Examples of inorganic fine particles include silica, alumina, titanium oxide, zirconium oxide, tin oxide, tungstic oxide, aluminium silicate (clay, kaolin), talc, attapulgite, sericite, mica, potassium titanate, barium titanate, bentonite, zeolite, pyrophyllite, zirconium oxide, zirconium silicate, hydrotalcite, chrysotile, xonotlite, wollastonite, and the like. Surface treatment may be provided on the inorganic fine particles described above.

The blend ratio of the filler particles and the binder on mass basis when forming the dye layer 30 is preferably filler particle/binder=1/100 to 10/100. This is because, when the blend ratio of filler particle/binder becomes lower than 1/100, thermal fusion bonding may occur between the dye layer and the aqueous-receiving layer of the thermal transfer image-receiving sheet during printing to generate shade unevenness at the high density part. Furthermore, when the blend ratio becomes larger than 10/100, film strength of the dye layer deteriorates and abnormal transfer may occur.

Examples of the thermal migratory dye and the binder used in the dye layer 30 include a thermal migratory dye and a binder similar to those used in the heat-sensitive transfer recording medium I.

In addition, the blend ratio of the thermal migratory dye and the binder on mass basis when forming the dye layer 30, the additives known in the art contained in the dye layer 30, and the applied amount of the dye layer 30 after drying may be similar to those for the heat-sensitive transfer recording medium I.

It should be noted that the heat-resistant slippage layer 40, the undercoating layer 20, and the dye layer 30 can all be formed using hitherto known methods in a manner similar for those in the heat-sensitive transfer recording medium I.

Next, description will be provided for a thermal transfer image-receiving sheet which is a transfer-target object used in the heat-sensitive transfer recording medium III according to the present invention.

The thermal transfer image-receiving sheet has an aqueous-receiving layer containing an aqueous binder and a mold releasing agent and being formed on a base material via an aqueous hallow particle layer containing an aqueous binder and hollow particles. The base material used in the thermal transfer image-receiving sheet is not particularly limited, and the base material can be appropriately selected from various materials, layer configurations, and sizes in accordance with the purpose of use etc. Examples of the base material include various papers such as paper, coated paper, and synthetic paper (polypropylene, polystyrene, or composite material obtained by attaching those with paper).

[Aqueous Hallow Particle Layer]

On the base material, an aqueous hallow particle layer that contains hollow particles and an adhesion component (aqueous binder) is formed. Printing through thermal transfer is performed by applying heat from the thermal head, and fine adhesion between the thermal head and the base material of the image-receiving sheet is required. Since the base material on which the aqueous hallow particle layer is formed has cushioning properties, adhesion with the thermal head is improved, and a more uniform image can be obtained during printing.

As the material for forming a particle wall of hollow particles, polymers such as acrylonitrile, vinylidene chloride, styrene acrylic ester, and the like are preferably used. Examples of the method for manufacturing the hollow particles include a method of sealing a foaming agent such as butane gas and the like in the resin particles, and heating and foaming the particles, emulsion polymerization methods, and the like. The method for heating and foaming include a method of using a foamed hallow particle that has been foamed in advance through heating of a hollow particle, and a method of forming a layer containing an unfoamed particle through coating etc., and heating the layer through a drying step or the like to form a hollow structure. From a standpoint of easily controlling the hollow rate and particle size of the hollow particles to be constant, the method of using a foamed hallow particle is generally preferable.

The aqueous binder used in the aqueous hallow particle layer is not particularly limited, and examples thereof include vinyl-based polymers including polymers and copolymers of water soluble polyvinyl alcohol, polyvinyl pyrrolidone, vinyl-based monomer, etc.

Although the applied amount of the aqueous hallow particle layer after drying is not limited unconditionally, the applied amount of about 5.0 to 40.0 g/m$^2$ is appropriate from a standpoint of cost and sufficient thermal insulation properties.

[Aqueous-Receiving Layer]

The aqueous-receiving layer containing the aqueous binder and the mold releasing agent is formed on the aqueous hallow particle layer which has been formed on the base material. As the aqueous binder, a dye-affinity resin having high affinity against a dye and excellent dyeing property can be suitably used.

Examples of the dye-affinity resin include vinyl chloride resins, urethane-based resins, polyester-based resins, polycarbonate resins, polyvinyl acetal resins, polyvinyl butyral resins, polystyrene resins, polyacrylic ester resins, acrylic resins, cellulose-based resins, polyamide resins, copolymer resins of a vinyl compound monomer and a monomer having a benzotriazole skeleton and/or benzophenone skeleton. With regard to these resins, a single type may be used by itself, or a combination of two or more types may be used. Among those described above, acrylic resins, copolymer resins of a vinyl compound monomer and a monomer having a benzotriazole skeleton and/or benzophenone skeleton, urethane-based resins are preferable, since a printed image will have superior light resistance. Since a urethane-based resin has a crystalline region within its molecule and abnormal transfer is unlikely to occur, a urethane-based resin is preferable. Since these dye-affinity resins that are to be used in the present invention are water soluble or water dispersible, i.e., aqueous, they are advantageous from the environmental load aspect.

When printing through thermal transfer, there is a step of peeling an ink ribbon from the receiving layer after overlaying a dye layer of the ink ribbon and the receiving layer on the thermal transfer image-receiving sheet and applying heat thereto using the thermal head. As a result, the receiving layer is required to also have releasability with respect to the ink ribbon. Therefore, in the present invention, the mold releasing agent is added to the aqueous-receiving layer for the purpose of preventing fusing with the ink ribbon and improving runnability during printing. Examples of the added mold releasing agent include silicone oil, polysiloxane graft acrylic resins, waxes, fluorine compounds, and the like.

It is also preferable to add a crosslinking agent to the aqueous-receiving layer to improve heat resistance. Preferable examples of the crosslinking agent include carbodiimide compounds, isocyanate compounds, oxazoline compounds, organic titanium chelate compounds, and the like. Among these crosslinking agents, carbodiimide-based crosslinking agents are preferable from a standpoint of having high heat resistance improving effect and unlikely to have runnability problems such as fusing of a ribbon during printing, and a standpoint of stability within the aqueous-receiving layer-forming application liquid.

The applied amount of the aqueous-receiving layer after drying is not limited unconditionally, and is preferably 0.5 to 5.0 g/m$^2$, and more preferably 0.5 to 4.0 g/m$^2$. When the applied amount is less than 0.5 g/m$^2$, light resistance of an image may become inferior. When the applied amount is more than 5.0 g/m$^2$, the dye diffuses within the aqueous-receiving layer, and blurring of an image may occur.

[Coating Method]

To the aqueous hallow particle layer and the aqueous-receiving layer, various assistants generally used in coated-paper manufacturing such as wetting agents, dispersants, thickening agents, defoaming agents, coloring agents, antistatic agents, preservatives, and the like can be added as appropriate. The aqueous hallow particle layer and the aqueous-receiving layer can be formed by, for example, coating a predetermined application liquid on each layer or simultaneously on two or more layers using a coater known in the art such as bar coaters, gravure coaters, comma coaters, blade coaters, air knife coaters, gate roll coaters, die coaters, curtain coaters, slide bead coaters, and the like, and then drying the application liquid.

Embodiment IV

Heat-Sensitive Transfer Recording Medium IV

A base material 10 similar to the base material 10 included in the heat-sensitive transfer recording medium I can be used.

In addition, on the base material 10, it is possible to provide an adhesion treatment on the surface where a heat-resistant slippage layer 40 and/or an undercoating layer 20 and/is formed, similarly to the heat-sensitive transfer recording medium I.

The heat-resistant slippage layer 40 can be formed in a manner similar to the heat-resistant slippage layer 40 in the heat-sensitive transfer recording medium I.

Here, the applied amount of the heat-resistant slippage layer 40 after drying refers to the amount of solid content remaining after the heat-resistant slippage layer-forming application liquid is applied and dried. Similarly, the applied amount of the undercoating layer 20 after drying and the applied amount of the dye layer 30 after drying described later refer to the amount of solid content remaining after applying and drying an undercoating layer-forming application liquid and a dye layer-forming application liquid, respectively, described later.

The undercoating layer 20 can also be formed in a manner similar to the undercoating layer 20 in the heat-sensitive transfer recording medium I.

The dye layer 30 is formed by applying and then drying a dye layer-forming application liquid prepared by, for example, blending, other a thermal migratory dye and a resin binder, a solvent and the like. It should be noted that the dye layer can be formed with a monolayer of a single color, or a plurality of dye layers containing dyes with different hues can be field-sequentially formed in a repeating manner on a single surface of a single base material.

Examples of the thermal migratory dye used in the dye layer 30 include a thermal migratory dye similar to that used in the heat-sensitive transfer recording medium I.

The resin binder used in the dye layer 30 is not particularly limited as long as the resin binder contains the polyvinyl acetal whose glass transition temperature is not lower than 100° C. and the polyvinyl butyral whose glass transition temperature is not higher than 75° C., and any hitherto known resin binder can be used.

Although the polyvinyl acetal whose glass transition temperature is not lower than 100° C. has high heat resistance, when energy provided to the thermal head such as a low density part is small, it becomes difficult to sublimate the dye, and sufficient transfer sensitivity cannot be obtained at the low density part. On the other hand, when the polyvinyl butyral whose glass transition temperature is not higher than 75° C. is used, although the dye can be easily sublimated and there is an advantage of having high transfer sensitivity particularly at the low density part, sufficient heat resistance cannot be obtained and a problem arises where wrinkles are generated on the image-receiving paper side. Thus, when these two types of resins are combined, it becomes possible to improve transfer sensitivity at the low density part and prevent wrinkles from occurring during printing.

Examples of the polyvinyl acetal whose glass transition temperature is not lower than 100° C. include Denka Butyral #5000-D (manufactured by Denki Kagaku Kogyo (K.K.)), Denka Butyral #6000-AS (manufactured by Denki Kagaku Kogyo (K.K.)), and the like. Examples the polyvinyl butyral whose glass transition temperature is not higher than 75° C. include Denka Butyral #3000-1 (manufactured by Denki Kagaku Kogyo (K.K.)), Denka Butyral #3000-2 (manufactured by Denki Kagaku Kogyo (K.K.)), and the like.

The content ratio of the polyvinyl acetal whose glass transition temperature is not lower than 100° C. and the polyvinyl butyral whose glass transition temperature is not higher than 75° C. on mass basis in the dye layer 30 is preferably polyvinyl acetal/polyvinyl butyral=50/50 to 97/3, and further preferably 60/40 to 90/10. When the content ratio of polyvinyl acetal/polyvinyl butyral is higher than 97/3, transfer sensitivity may be insufficient at the low density part during high-speed printing. On the other hand, when the content ratio of polyvinyl acetal/polyvinyl butyral is lower than 50/50, although increased transfer sensitivity at the low density part can be attained since the polyvinyl butyral enhances sublimation of the dye compared to the polyvinyl acetal, sufficient heat resistance cannot be obtained, and wrinkles may occur during printing. Thus, by using the polyvinyl acetal and the polyvinyl butyral in the above described content ratio as the resin binders, it becomes possible to increase transfer sensitivity at the low density part and prevent wrinkles from occurring during printing.

Resin binders that can be used in the dye layer 30 other than the polyvinyl acetal whose glass transition temperature is not lower than 100° C. and the polyvinyl butyral whose glass transition temperature is not higher than 75° C. is not particularly limited, and examples of such resin binders include cellulose-based resins such as ethyl cellulose, hydroxyethyl cellulose, ethylhydroxy cellulose, hydroxypropyl cellulose, and cellulose acetate, vinyl-based resins such as polyvinyl alcohol, polyvinyl acetate, polyvinyl pyrrolidone, and polyacrylamide, polyester resins, styrene-acrylonitrile copolymer resins, phenoxy resins, and the like.

Here, the blend ratio of the thermal migratory dye and the resin binder on mass basis when forming the dye layer 30 is preferably thermal migratory dye/resin binder=10/90 to 75/25. This is because, when the blend ratio of thermal migratory dye/resin binder is lower than 10/90, coloring sensitivity becomes insufficient due to the amount of dye being too small, and excellent thermal transfer images cannot be obtained. In addition, when the blend ratio is higher than 75/25, solubility of the dye with respect to the resin binder decreases extremely, and preservation stability of the obtained heat-sensitive transfer recording medium deteriorates and the dye may easily precipitate.

Additives known in the art contained in the dye layer 30 and the applied amount of the dye layer 30 after drying may be similar to those for the heat-sensitive transfer recording medium I.

It should be noted that the heat-resistant slippage layer 40, the undercoating layer 20, and the dye layer 30 can all be formed in a manner similar to the heat-sensitive transfer recording medium I using hitherto known methods.

Embodiment V

Heat-Sensitive Transfer Recording Medium V

A base material 10 similar to the base material 10 included in the heat-sensitive transfer recording medium I can be used. In addition, on the base material 10, it is possible to provide an adhesion treatment on the surface where a heat-resistant slippage layer 40 and/or an undercoating layer 20 and/is formed, similarly to the heat-sensitive transfer recording medium I.

The heat-resistant slippage layer 40 can be formed in a manner similar to the heat-resistant slippage layer 40 in the heat-sensitive transfer recording medium I.

Here, the applied amount of the heat-resistant slippage layer 40 after drying refers to the amount of solid content remaining after the heat-resistant slippage layer-forming application liquid is applied and dried. Similarly, the applied amount of the undercoating layer 20 after drying and the applied amount of the dye layer 30 after drying described later refer to the amount of solid content remaining after applying and drying an undercoating layer-forming application liquid and a dye layer-forming application liquid, respectively, described later. Similarly, the applied amount of the aqueous hallow particle layer after drying and the applied amount of the aqueous-receiving layer after drying described later also refer to the amount of solid content remaining after applying and drying an aqueous hollow particle layer-forming application liquid and an aqueous-receiving layer-forming application liquid, respectively, described later.

The undercoating layer 20 can also be formed in a manner similar to the undercoating layer 20 in the heat-sensitive transfer recording medium I.

The dye layer 30 is formed by applying and then drying a dye layer-forming application liquid prepared by, for example, blending, other than a mold releasing agent and a thermal migratory dye, a binder, a solvent, and the like. It should be noted that the dye layer can be formed with a monolayer of a single color, or a plurality of dye layers containing dyes with different hues can be field-sequentially formed in a repeating manner on a single surface of a single base material.

As the mold releasing agent, at least two types of modified silicone oils including a nonreactive silicone oil whose number average molecular weight is not smaller than 8000 and a reactive silicone oil whose number average molecular weight is not larger than 3000 are used to provide superior safety and cost. By adding two or more types of modified silicone oils having different molecular weight as the mold releasing agent, it becomes possible to improve adhesion between the aqueous-receiving layer and the dye layer, occurring at intermediate to high density parts, and abnormal transfer of the dye layer, occurring at the intermediate density part, both.

Since a mold releasing agent that is nonreactive and is dispersed in the dye layer is effective for improving adhesion between the aqueous-receiving layer and the dye layer, occurring at intermediate to high density parts; the nonreactive silicone oil whose number average molecular weight is not smaller than 8000 becomes necessary. It should be noted that, from a standpoint of efficiently expressing the improving effect against adhesion between the aqueous-receiving layer and the dye layer, occurring at intermediate to high density parts; the number average molecular weight of the nonreactive silicone oil is preferably 8000 to 15000. Although examples of the nonreactive silicone oil whose number average molecular weight is not smaller than 8000 include a side-chain polyether modified silicone oil whose introduced organic group is a polyether group, and a both-ends long-chain alkyl modified silicone oil whose introduced organic group is a long chain alkyl group, and the like; the side-chain polyether modified silicone oil is particularly preferable from a standpoint of enhancing the improving effect against adhesion between the aqueous-receiving layer and the dye layer, occurring at intermediate to high density parts.

Since a mold releasing agent that is reactive and is localized on the dye layer surface is effective for improving abnormal transfer of the dye layer, occurring at the intermediate density part; the reactive silicone oil whose number average molecular weight is not larger than 3000 becomes necessary. It should be noted that, from a standpoint of efficiently expressing the improving effect against abnormal transfer of the dye layer, occurring at the intermediate density part; the number average molecular weight of the reactive silicone oil is preferably 300 to 3000. Although examples of the reactive silicone oil whose number average molecular weight is not larger than 3000 include a side-chain diamine modified silicone oil whose introduced organic group is diamino group, a both-ends amino modified silicone oil whose introduced organic group is amino group, and the like; the side-chain diamine modified silicone oil is particularly preferable from a standpoint of enhancing the improving effect against abnormal transfer of the dye layer, occurring at the intermediate density part.

The blend ratio of the nonreactive silicone oil and the reactive silicone oil on mass basis is preferably nonreactive silicone oil/reactive silicone oil=1/10 to 10/1. When the blend ratio of nonreactive silicone oil/reactive silicone oil is lower than 1/10, the improving effect against adhesion between the aqueous-receiving layer and the dye layer, occurring at intermediate to high density parts, may become insufficient. When the blend ratio is higher than 10/1, the improving effect against abnormal transfer of the dye layer, occurring at the intermediate density part, may become insufficient.

The blend ratio of the mold releasing agent and the binder on mass basis when forming the dye layer 30 is preferably mold releasing agent/binder=0.1/100 to 10/100. When the blend ratio of mold releasing agent/binder is lower than 0.1/100, releasing ability deteriorates and the improving effect against adhesion and abnormal transfer may not be exerted. When the blend ratio is higher than 10/100, foamability during coating may deteriorate and print wrinkles may occur during printing.

Examples of the thermal migratory dye and the binder used in the dye layer 30 include a thermal migratory dye and a binder similar to those used in the heat-sensitive transfer recording medium I.

In addition, the blend ratio of the thermal migratory dye and the binder on mass basis when forming the dye layer 30, the additives known in the art contained in the dye layer 30, and the applied amount of the dye layer 30 after drying may be similar to those for the heat-sensitive transfer recording medium I.

It should be noted that the heat-resistant slippage layer 40, the undercoating layer 20, and the dye layer 30 can all be formed in a manner similar to the heat-sensitive transfer recording medium I using hitherto known methods.

As a thermal transfer image-receiving sheet which is a transfer-target object used in the heat-sensitive transfer recording medium V according to the present invention, a thermal transfer image-receiving sheet similar to that used in the heat-sensitive transfer recording medium III according to the present invention may be used.

EXAMPLES

In the following, materials used in each Example and each Comparative Example of the present invention are shown. It should be noted that, unless mentioned otherwise in particular, "part(s)" in the description is mass basis. The present invention is not limit to these Examples.

(I) Embodiment I

Examples Corresponding to the Heat-Sensitive Transfer Recording Medium I and Comparative Examples Thereof <Production of Base Material with Heat-Resistant Slippage Layer>

A base material with a heat-resistant slippage layer was obtained by using a single-side adhesion-eased polyethylene terephthalate film having a thickness of 4.5 μm as the base material, applying, on a non-adhesion-eased surface thereof, a heat-resistant slippage layer-forming application liquid having the following composition through gravure coating such that the applied amount after drying was 0.5 g/m$^2$, and drying the base material at 100° C. for 1 minute.

<Heat-Resistant Slippage Layer-Forming Application Liquid>

| | |
|---|---|
| Silicon modified acrylic resin (US-350 manufactured by Toagosei (K.K.)) | 50.0 parts |
| Methyl ethyl ketone | 50.0 parts |

<Preparation of Polyvinyl Alcohol>

In a reaction container including an agitator, a thermometer, a nitrogen guide tube, and a reflux condenser, 100 parts of vinyl acetate and 10 parts of methanol were loaded, nitrogen gas was bubbled therethrough, the mixture was deaired and had its temperature increase to a reflux condition, reflux was performed thereon for 20 minutes, and azobisisobutyronitrile was added thereto at 0.3 mol % with respect to vinyl acetate. Next, after polymerization for 20 minutes, the polymerization was stopped through cooling to obtain a methanol solution of polyvinyl acetate. The polymerization rate was 95%. Next, monomers were expelled using a continuous monomer-removing tower until the amount of residual monomers in the methanol solution was 0.06%, methanol was added thereto to adjust the polyvinyl acetate concentration to 50%, and sodium hydroxide was added to the methanol solution at 5 mmol with respect to vinyl acetate monomers as a unit to perform saponification at 40° C. for 90 minutes. The saponified product that had precipitated was neutralized using acetic acid, and the produced polyvinyl alcohol resin composition was separated therefrom through filtration, rinsed thoroughly with methanol, dried in a hot air dryer to obtain the intended polyvinyl alcohol. The obtained polyvinyl alcohol had a degree of saponification of 94 mol % and an average degree of polymerization of 2200. In addition, polyvinyl alcohol having a degree of saponification of 88 mol % and an average degree of polymerization of 2200 was obtained by extracting a solution in mid-course of the saponification.

<Tensile Strength Measurement of Polyvinyl Alcohol Film>

15.0 parts of each obtained polyvinyl alcohol was dissolved in 85.0 parts of 90° C. hot water, flow casted on a glass petri dish, dried at room temperature for 24 minutes to obtain a film having a thickness of 0.06 mm. Each obtained film was cut out in No. 2 dumbbell shape in accordance with JIS K 7113, tensile test was performed at tension speed of 200 mm/min, and tensile strength was measured. There resulting values were 8.2 kg/mm$^2$ for the polyvinyl alcohol having a degree of saponification of 94 mol % and an average degree of polymerization of 2200, and 6.8 kg/mm$^2$ for the polyvinyl alcohol having a degree of saponification of 88 mol % and an average degree of polymerization of 2200. In addition, a film was produced in a similar manner using commercially available Kuraray Poval PVA-117 (manufactured by Kuraray (K.K.)), and a tensile strength thereof was measured at 7.4 kg/mm$^2$.

Example I-1

On the adhesion-eased surface of the base material with the heat-resistant slippage layer, an undercoating layer-forming application liquid I-1 having the following composition was applied through gravure coating such that the applied amount after drying was 0.20 g/m$^2$, and the base material was dried at 100° C. for 2 minutes to form an undercoating layer. Then, on the undercoating layer, a dye layer-forming application liquid I-1 having the following composition was applied through gravure coating such that the applied amount after drying was 0.70 g/m$^2$ and dried at 90° C. for 1 minute to form a dye layer to obtain a heat-sensitive transfer recording medium of Example I-1.

<Undercoating Layer-Forming Application Liquid I-1>

| | |
|---|---|
| Polyvinyl alcohol (tensile strength: 8.2 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

<Dye Layer-Forming Application Liquid I-1>

| | |
|---|---|
| C.I. Solvent blue 63 (anthraquinone dye) | 6.0 parts |
| Polyvinyl acetal | 4.0 parts |
| Toluene | 45.0 parts |
| Methyl ethyl ketone | 45.0 parts |

Example I-2

A heat-sensitive transfer recording medium of Example I-2 was obtained in a manner similar to Example I-1, except for forming an undercoating layer using an undercoating layer-forming application liquid I-2 having the following composition in the heat-sensitive transfer recording medium produced in Example I-1.

<Undercoating Layer-Forming Application Liquid I-2>

| | |
|---|---|
| Polyvinyl alcohol (tensile strength: 8.2 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Example I-3

A heat-sensitive transfer recording medium of Example I-3 was obtained in a manner similar to Example I-1, except for forming an undercoating layer using an undercoating layer-forming application liquid I-3 having the following composition in the heat-sensitive transfer recording medium produced in Example I-1.

<Undercoating Layer-Forming Application Liquid I-3>

| | |
|---|---|
| Polyvinyl alcohol (tensile strength: 8.2 kg/mm$^2$) | 1.5 parts |
| Polyvinyl pyrrolidone (homopolymer of N-vinyl-2-pyrrolidone) | 3.5 parts |
| Pure water | 57.0 parts |
| Isopropyl alcohol | 38.0 parts |

Example I-4

A heat-sensitive transfer recording medium of Example I-4 was obtained in a manner similar to Example I-1, except for setting the applied amount of the undercoating layer after drying to 0.03 g/m$^2$ in the heat-sensitive transfer recording medium produced in Example I-1.

Example I-5

A heat-sensitive transfer recording medium of Example I-5 was obtained in a manner similar to Example I-1, except for setting the applied amount of the undercoating layer after drying to 0.40 g/m$^2$ in the heat-sensitive transfer recording medium produced in Example I-1.

Comparative Example I-1

A heat-sensitive transfer recording medium of Comparative Example I-1 was obtained in a manner similar to Example I-1, except for not forming an undercoating layer in the heat-sensitive transfer recording medium produced in Example I-1.

Comparative Example I-2

A heat-sensitive transfer recording medium of Comparative Example I-2 was obtained in a manner similar to Example I-1, except for forming an undercoating layer using an undercoating layer-forming application liquid I-4 having the following composition in the heat-sensitive transfer recording medium produced in Example I-1.

<Undercoating Layer-Forming Application Liquid I-4>

| | |
|---|---|
| Polyvinyl alcohol (tensile strength: 6.8 kg/mm$^2$ | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

Comparative Example I-3

A heat-sensitive transfer recording medium of Comparative Example I-3 was obtained in a manner similar to Example I-1, except for forming a dye layer using a dye layer-forming application liquid I-2 having the following composition in the heat-sensitive transfer recording medium produced in Example I-1.

<Dye Layer-Forming Application Liquid I-2>

| | |
|---|---|
| C.I. Solvent blue 266 (azo dye) | 3.0 parts |
| Polyvinyl acetal | 2.0 parts |
| Toluene | 47.5 parts |
| Methyl ethyl ketone | 47.5 parts |

Comparative Example I-4

A heat-sensitive transfer recording medium of Comparative Example I-4 was obtained in a manner similar to Example I-1, except for forming an undercoating layer using the undercoating layer-forming application liquid I-4 and forming a dye layer using the dye layer-forming application liquid I-2 in the heat-sensitive transfer recording medium produced in Example I-1.

Comparative Example I-5

A heat-sensitive transfer recording medium of Comparative Example I-5 was obtained in a manner similar to Example I-1, except for forming an undercoating layer using an undercoating layer-forming application liquid I-5 having the following composition in the heat-sensitive transfer recording medium produced in Example I-1.

<Undercoating Layer-Forming Application Liquid I-5>

| | |
|---|---|
| Polyvinyl alcohol (tensile strength: 8.2 kg/mm$^2$) | 5.0 parts |
| Pure water | 57.0 parts |
| Isopropyl alcohol | 38.0 parts |

Comparative Example I-6

A heat-sensitive transfer recording medium of Comparative Example I-6 was obtained in a manner similar to Example I-1, except for forming an undercoating layer using an undercoating layer-forming application liquid I-6 having the following composition in the heat-sensitive transfer recording medium produced in Example I-1.

<Undercoating Layer-Forming Application Liquid I-6>

| | |
|---|---|
| Polyvinyl pyrrolidone (homopolymer of N-vinyl-2-pyrrolidone) | 5.0 parts |
| Pure water | 57.0 parts |
| Isopropyl alcohol | 38.0 parts |

Comparative Example I-7

A heat-sensitive transfer recording medium of Comparative Example I-7 was obtained in a manner similar to Example I-1, except for forming an undercoating layer using an undercoating layer-forming application liquid I-7 having the following composition in the heat-sensitive transfer recording medium produced in Example I-1.

<Undercoating Layer-Forming Application Liquid I-7>

| | |
|---|---|
| Polyvinyl alcohol (PVA-117 manufactured by Kuraray (K.K.), tensile strength: 7.4 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

<Production of Transfer-Target Object>

A transfer-target object for heat-sensitive transferring was produced by using a white foam polyethylene terephthalate film having a thickness of 188 μm as the base material, applying, on one surface thereof, an image-receiving layer-forming application liquid having the following composition through gravure coating such that the applied amount after drying was 5.0 g/m$^2$, and then drying the base material.

<Image-Receiving Layer-Forming Application Liquid>

| | |
|---|---|
| Vinyl chloride-vinyl acetate-vinyl alcohol copolymer | 19.5 parts |
| Amino modified silicone oil | 0.5 parts |
| Toluene | 40.0 parts |
| Methyl ethyl ketone | 40.0 parts |

<Evaluation of Adhesion of Dye Layer>

For each of the heat-sensitive transfer recording media of Examples I-1 to I-5 and Comparative Examples I-1 to I-7, a cellophane tape having a width of 24 mm and a length of 150 mm was adhered to the dye layer of the heat-sensitive transfer recording medium, and then peeled off immediately. Adhesion of the dye layer was evaluated by inspecting whether or not the dye layer had adhered to the cellophane tape side. The results are shown in Table 1.

Evaluation of adhesion of the dye layer was performed using the following criteria.

○: Adhesion of the dye layer is not observed.

Δ: Very slight adhesion of the dye layer is observed.

x: Adhesion of the dye layer is observed on the whole surface.

It should be noted that Δ or better is the level that is not a problem for practical use.

<Print Evaluation>

Print evaluation was conducted through solid-printing with a thermal simulator using the heat-sensitive transfer recording media of Examples I-1 to I-5 and Comparative Examples I-1 to I-7, and measuring the highest reflection density. The results are shown in Table 1. It should be noted that the highest reflection density is a value measured with a spectrodensitometer "X-rite 528" manufactured by X-rite Inc.

The following printing conditions were used.

Printing environment: 23° C., 50% RH.

Applied voltage: 29 V.

Line period: 0.7 msec.

Print density: Horizontal scanning of 300 dpi, vertical scanning of 300 dpi.

<Abnormal Transfer>

Abnormal transfer was evaluated using the following criteria for the heat-sensitive transfer recording media of Examples I-1 to I-5 and Comparative Examples I-1 to I-7. The results are shown in Table 1.

○: Abnormal transfer to the transfer-target object is not observed.

Δ: Very slight abnormal transfer to the transfer-target object is observed.

x: Abnormal transfer to the transfer-target object is observed on the whole surface.

It should be noted that Δ or better is the level that is not a problem for practical use.

TABLE 1

| | Highest reflection density | Adhesion of dye layer | Abnormal transfer |
|---|---|---|---|
| Example | | | |
| I-1 | 2.53 | ○ | ○ |
| I-2 | 2.58 | Δ | Δ |
| I-3 | 2.40 | ○ | ○ |
| I-4 | 2.50 | Δ | Δ |
| I-5 | 2.45 | ○ | ○ |
| Comparative Example | | | |
| I-1 | 1.83 | ○ | ○ |
| I-2 | 1.95 | ○ | ○ |
| I-3 | 1.99 | ○ | ○ |
| I-4 | 1.91 | ○ | ○ |
| I-5 | unmeasurable | Δ | x |
| I-6 | 1.98 | ○ | ○ |
| I-7 | 2.12 | ○ | ○ |

From the results shown in Table 1, when compared to the heat-sensitive transfer recording medium of Comparative Example I-1 not provided with an undercoating layer, it was shown that the heat-sensitive transfer recording media of Examples I-1 to I-5 clearly had high transfer sensitivity during high-speed printing, and a large cost-cutting effect through reduction of dye used in a dye layer. It was also shown that there were no problems for practical use in adhesion with a dye layer and abnormal transfer during printing.

The heat-sensitive transfer recording medium of Example I-2 had a content ratio of polyvinyl alcohol and polyvinyl pyrrolidone on mass basis of polyvinyl alcohol/polyvinyl pyrrolidone=8/2, and, possibly because of a low polyvinyl pyrrolidone ratio, the heat-sensitive transfer recording medium resulted in slightly reduced adhesion with a dye layer when compared to the heat-sensitive transfer recording medium of Example I-1.

The heat-sensitive transfer recording medium of Example I-3 had a content ratio of polyvinyl alcohol and polyvinyl pyrrolidone on mass basis of polyvinyl alcohol/polyvinyl pyrrolidone=3/7, and, possibly because of a low polyvinyl alcohol ratio, the heat-sensitive transfer recording medium resulted in slightly reduced transfer sensitivity (highest reflection density) when compared to the heat-sensitive transfer recording medium of Example I-1.

The heat-sensitive transfer recording medium of Example I-4 resulted in slightly reduced adhesion with a dye layer when compared to the heat-sensitive transfer recording medium of Example I-1, possibly because the applied amount of the undercoating layer was less than 0.05 g/m$^2$.

The heat-sensitive transfer recording medium of Example I-5 resulted in slightly reduced transfer sensitivity when compared to the heat-sensitive transfer recording medium of Example I-1, possibly because the applied amount of the undercoating layer was more than 0.30 g/m$^2$.

On the other hand, as a result of using polyvinyl alcohol whose tensile strength measured based on JIS K 7113 was lower than 8 kg/mm$^2$, the heat-sensitive transfer recording medium of Comparative Example I-2 resulted in significantly reduced transfer sensitivity when compared to the heat-sensitive transfer recording medium of Example I-1.

The heat-sensitive transfer recording medium of Comparative Example I-3 whose dye layer was formed of a dye not containing an anthraquinone compound was also shown to have significantly reduced transfer sensitivity when compared to the heat-sensitive transfer recording medium of Example I-1.

The heat-sensitive transfer recording medium of Comparative Example I-4 in which polyvinyl alcohol having a tensile strength lower than 8 kg/mm$^2$ measured based on JIS K 7113 was used and whose dye layer was formed of a dye not containing an anthraquinone compound resulted in further reduced transfer sensitivity when compared to the heat-sensitive transfer recording media of Comparative Examples I-2 and I-3. When transfer sensitivities were compared between Comparative Example I-3 in which polyvinyl alcohol having a tensile strength not lower than 8 kg/mm$^2$ measured based on JIS K 7113 was used, and Comparative Example I-4 in which polyvinyl alcohol having a tensile strength lower than 8 kg/mm$^2$ was used; the difference was small, and it was shown that the effect of tensile strength of polyvinyl alcohol on transfer sensitivity was small when a dye layer formed of a dye not containing an anthraquinone compound was used. From this, it was shown that dramatically high transfer sensitivity was obtained by using polyvinyl alcohol having a tensile strength not lower than 8 kg/mm$^2$ measured based on JIS K 7113, and using a thermal migratory dye containing an anthraquinone compound in a dye layer.

In the heat-sensitive transfer recording medium of Comparative Example I-5, as a result of applying and then drying an undercoating layer-forming application liquid containing only polyvinyl alcohol to form an undercoating layer; adhesion with a dye layer was reduced and abnormal transfer was observed on the whole surface when compared to the heat-sensitive transfer recording medium of the Example I-1.

In the heat-sensitive transfer recording medium of Comparative Example I-6 as a result of applying and then drying an undercoating layer-forming application liquid containing only polyvinyl pyrrolidone to form an undercoating layer; although there were no problems regarding adhesion with a dye layer, transfer sensitivity was significantly reduced when compared to the heat-sensitive transfer recording medium of Example I-1.

In the heat-sensitive transfer recording medium of Comparative Example I-7, PVA-117 (manufactured by Kuraray (K.K.)), which is a commercially available product, was used as polyvinyl alcohol for an undercoating layer. Since the tensile strength of the PVA-117 measured based on JIS K 7113 was lower than 8 kg/mm$^2$, the heat-sensitive transfer recording medium of Comparative Example I-7 resulted in low transfer sensitivity and was not sufficiently satisfactory when compared to the heat-sensitive transfer recording media of Examples I-1 to I-5 in which polyvinyl alcohol having a tensile strength not lower than 8 kg/mm$^2$ was used.

(II) Embodiment II

Examples corresponding to the Heat-Sensitive Transfer Recording Medium II and Comparative Examples Thereof <Preparation of Polyvinyl Alcohol>

By using a method similar to the method in Examples corresponding to Embodiment I in (I) above and Comparative Examples thereof, polyvinyl alcohol having a degree of saponification of 94 mol % and an average degree of polymerization of 2200, and polyvinyl alcohol having a degree of saponification of 88 mol % and an average degree of polymerization of 2200 were obtained.

<Tensile Strength Measurement of Polyvinyl Alcohol Film>

Tensile strength was measured by using a method similar to the method in Examples corresponding to Embodiment I in (I) above and Comparative Examples thereof. The resulting values were 8.2 kg/mm$^2$ for the polyvinyl alcohol having a degree of saponification of 94 mol % and an average degree of polymerization of 2200, and 6.8 kg/mm$^2$ for the polyvinyl alcohol having a degree of saponification of 88 mol % and an average degree of polymerization of 2200, and 7.4 kg/mm$^2$ for Kuraray Poval PVA-117.

Example II-1

A base material with a heat-resistant slippage layer was obtained by using a single-side adhesion-eased polyethylene terephthalate film having a thickness of 4.5 μm as the base material, applying, on a non-adhesion-eased surface thereof, a heat-resistant slippage layer-forming application liquid II-1 having the following composition through gravure coating such that the applied amount after drying was 1.0 g/m$^2$, and drying the base material at 100° C. for 1 minute.

On the adhesion-eased surface of the base material with the heat-resistant slippage layer, an undercoating layer-forming application liquid II-1 having the following composition was applied through gravure coating such that the applied amount after drying was 0.20 g/m$^2$, and the base material was dried at 100° C. for 2 minutes to form an undercoating layer. Then, on the undercoating layer, a dye layer-forming application liquid II-1 having the following composition was applied through gravure coating such that the applied amount after drying was 0.70 g/m$^2$, dried at 90° C. for 1 minute to form a dye layer, and a heat-sensitive transfer recording medium of Example II-1 was obtained.

<Heat-Resistant Slippage Layer-Forming Application Liquid II-1>

| | |
|---|---|
| Acrylic polyol (solid content: 50%) | 20.0 parts |
| Phosphate ester (melting point: 15° C.) | 2.0 parts |
| Phosphate ester (melting point: 70° C.) | 2.0 parts |
| Zinc stearate (melting point: 115 to 125° C.) | 2.0 parts |
| Talc (mean particle diameter: 1.0 μm) | 1.0 part |
| Talc (mean particle diameter: 2.5 μm) | 4.0 parts |
| 2,6-Tolylene diisocyanate prepolymer | 5.0 parts |
| Toluene | 49.5 parts |
| Methyl ethyl ketone | 20.0 parts |
| Ethyl acetate | 5.0 parts |

<Undercoating Layer-Forming Application Liquid II-1>

| | |
|---|---|
| Polyvinyl alcohol (tensile strength: 8.2 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

<Dye Layer-Forming Application Liquid II-1>

| | |
|---|---|
| C.I. Solvent blue 63 (anthraquinone dye) | 6.0 parts |
| Polyvinyl acetal | 4.0 parts |
| Toluene | 45.0 parts |
| Methyl ethyl ketone | 45.0 parts |

Example II-2

A heat-sensitive transfer recording medium of Example II-2 was obtained in a manner similar to Example II-1, except for forming an undercoating layer using an undercoating layer-forming application liquid II-2 having the following composition in the heat-sensitive transfer recording medium produced in Example II-1.

<Undercoating Layer-Forming Application Liquid II-2>

| | |
|---|---|
| Polyvinyl alcohol (tensile strength: 8.2 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Example II-3

A heat-sensitive transfer recording medium of Example II-3 was obtained in a manner similar to Example II-1, except for forming an undercoating layer using an undercoating layer-forming application liquid II-3 having the following composition in the heat-sensitive transfer recording medium produced in Example II-1.

<Undercoating Layer-Forming Application Liquid II-3>

| | |
|---|---|
| Polyvinyl alcohol (tensile strength: 8.2 kg/mm$^2$) | 1.5 parts |
| Polyvinyl pyrrolidone (homopolymer of N-vinyl-2-pyrrolidone) | 3.5 parts |
| Pure water | 57.0 parts |
| Isopropyl alcohol | 38.0 parts |

Example II-4

A heat-sensitive transfer recording medium of Example II-4 was obtained in a manner similar to Example II-1, except for setting the applied amount of the undercoating layer after drying to 0.03 g/m$^2$ in the heat-sensitive transfer recording medium produced in Example II-1.

Example II-5

A heat-sensitive transfer recording medium of Example II-5 was obtained in a manner similar to Example II-1, except for setting the applied amount of the undercoating layer after drying to 0.40 g/m$^2$ in the heat-sensitive transfer recording medium produced in Example II-1.

Example II-6

A heat-sensitive transfer recording medium of Example II-6 was obtained in a manner similar to Example II-1, except for forming a heat-resistant slippage layer using a heat-resistant slippage layer-forming application liquid II-2 having the following composition in the heat-sensitive transfer recording medium produced in Example II-1.

<Heat-Resistant Slippage Layer-Forming Application Liquid II-2>

| | |
|---|---|
| Acrylic polyol (solid content: 50%) | 20.0 parts |
| Phosphate ester (melting point: 15° C.) | 2.0 parts |
| Phosphate ester (melting point: 70° C.) | 2.0 parts |
| Zinc stearate (melting point: 115 to 125° C.) | 2.0 parts |
| Talc (mean particle diameter: 2.5 μm | 5.0 parts |
| Talc (mean particle diameter: 3.5 μm | 1.0 part |
| 2,6-Tolylene diisocyanate prepolymer | 5.0 parts |
| Toluene | 46.0 parts |
| Methyl ethyl ketone | 20.0 parts |
| Ethyl acetate | 5.0 parts |

Example II-7

A heat-sensitive transfer recording medium of Example II-7 was obtained in a manner similar to Example II-1, except for forming a heat-resistant slippage layer using a heat-resistant slippage layer-forming application liquid II-3 having the following composition in the heat-sensitive transfer recording medium produced in Example II-1.

<Heat-Resistant Slippage Layer-Forming Application Liquid II-3>

| | |
|---|---|
| Acrylic polyol (solid content: 50%) | 20.0 parts |
| Phosphate ester (melting point: 15° C.) | 2.0 parts |
| Phosphate ester (melting point: 70° C.) | 2.0 parts |
| Zinc stearate (melting point: 115 to 125° C.) | 2.0 parts |
| Talc (mean particle diameter: 2.5 μm | 1.0 part |
| 2,6-Tolylene diisocyanate prepolymer | 5.0 parts |
| Toluene | 47.5 parts |
| Methyl ethyl ketone | 20.0 parts |
| Ethyl acetate | 5.0 parts |

Comparative Example II-1

A heat-sensitive transfer recording medium of Comparative Example II-1 was obtained in a manner similar to Example II-1, except for not forming an undercoating layer in the heat-sensitive transfer recording medium produced in Example II-1.

Comparative Example II-2

A heat-sensitive transfer recording medium of Comparative Example II-2 was obtained in a manner similar to Example II-1, except for forming an undercoating layer using an undercoating layer-forming application liquid II-4 having the following composition in the heat-sensitive transfer recording medium produced in Example II-1.

<Undercoating Layer-Forming Application Liquid II-4>

| | |
|---|---|
| Polyvinyl alcohol (tensile strength: 6.8 kg/mm$^2$ | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

Comparative Example II-3

A heat-sensitive transfer recording medium of Comparative Example II-3 was obtained in a manner similar to Example II-1, except for forming a dye layer using a dye layer-forming application liquid II-2 having the following composition in the heat-sensitive transfer recording medium produced in Example II-1.

<Dye Layer-Forming Application Liquid II-2>

| | |
|---|---|
| C.I. Solvent blue 266 (azo dye) | 3.0 parts |
| Polyvinyl acetal | 2.0 parts |
| Toluene | 47.5 parts |
| Methyl ethyl ketone | 47.5 parts |

Comparative Example II-4

A heat-sensitive transfer recording medium of Comparative Example II-4 was obtained in a manner similar to Example II-1, except for forming an undercoating layer using the undercoating layer-forming application liquid II-4 and forming a dye layer using the dye layer-forming application liquid II-2 in the heat-sensitive transfer recording medium produced in Example II-1.

Comparative Example II-5

A heat-sensitive transfer recording medium of Comparative Example II-5 was obtained in a manner similar to Example II-1, except for forming an undercoating layer using an undercoating layer-forming application liquid II-5 having the following composition in the heat-sensitive transfer recording medium produced in Example II-1.

<Undercoating Layer-Forming Application Liquid II-5>

| | |
|---|---|
| Polyvinyl alcohol (tensile strength: 8.2 kg/mm$^2$) | 5.0 parts |
| Pure water | 57.0 parts |
| Isopropyl alcohol | 38.0 parts |

Comparative Example II-6

A heat-sensitive transfer recording medium of Comparative Example II-6 was obtained in a manner similar to Example II-1, except for forming an undercoating layer using an undercoating layer-forming application liquid II-6 having the following composition in the heat-sensitive transfer recording medium produced in Example II-1.

<Undercoating Layer-Forming Application Liquid II-6>

| | |
|---|---|
| Polyvinyl pyrrolidone (homopolymer of N-vinyl-2-pyrrolidone) | 5.0 parts |
| Pure water | 57.0 parts |
| Isopropyl alcohol | 38.0 parts |

Comparative Example II-7

A heat-sensitive transfer recording medium of Comparative Example II-7 was obtained in a manner similar to Example II-1, except for forming an undercoating layer using an undercoating layer-forming application liquid II-7 having the following composition in the heat-sensitive transfer recording medium produced in Example II-1.

<Undercoating Layer-Forming Application Liquid II-7>

| | |
|---|---|
| Polyvinyl alcohol (PVA-117 manufactured by Kuraray (K.K.), tensile strength: 7.4 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Comparative Example II-8

A heat-sensitive transfer recording medium of Comparative Example II-8 was obtained in a manner similar to Example II-1, except for forming a heat-resistant slippage layer using a heat-resistant slippage layer-forming application liquid II-4 having the following composition in the heat-sensitive transfer recording medium produced in Example II-1.

<Heat-Resistant Slippage Layer-Forming Application Liquid II-4>

| | |
|---|---|
| Acrylic polyol (solid content: 50%) | 20.0 parts |
| Zinc stearate (melting point: 115 to 125° C.) | 2.0 parts |
| Talc (mean particle diameter: 0.6 μm) | 4.0 parts |
| 2,6-Tolylene diisocyanate prepolymer | 5.0 parts |
| Toluene | 49.5 parts |
| Methyl ethyl ketone | 20.0 parts |
| Ethyl acetate | 5.0 parts |

Comparative Example II-9

A heat-sensitive transfer recording medium of Comparative Example II-9 was obtained in a manner similar to Example II-1, except for forming a heat-resistant slippage layer using a heat-resistant slippage layer-forming application liquid II-5 having the following composition in the heat-sensitive transfer recording medium produced in Example II-1.

<Heat-Resistant Slippage Layer-Forming Application Liquid II-5>

| | |
|---|---|
| Acrylic polyol (solid content: 50%) | 20.0 parts |
| Phosphate ester (melting point: 15° C.) | 2.0 parts |
| Phosphate ester (melting point: 70° C.) | 2.0 parts |
| Zinc stearate (melting point: 115 to 125° C.) | 2.0 parts |

-continued

| | |
|---|---|
| Talc (mean particle diameter: 2.5 μm) | 5.0 parts |
| Talc (mean particle diameter: 3.5 μm) | 2.0 parts |
| 2,6-Tolylene diisocyanate prepolymer | 5.0 parts |
| Toluene | 46.0 parts |
| Methyl ethyl ketone | 20.0 parts |
| Ethyl acetate | 5.0 parts |

Comparative Example II-10

A heat-sensitive transfer recording medium of Comparative Example II-10 was obtained in a manner similar to Example II-1, except for forming a heat-resistant slippage layer using a heat-resistant slippage layer-forming application liquid II-6 having the following composition in the heat-sensitive transfer recording medium produced in Example II-1.

<Heat-Resistant Slippage Layer-Forming Application Liquid II-6>

| | |
|---|---|
| Acrylic polyol (solid content: 50%) | 20.0 parts |
| Phosphate ester (melting point: 15° C.) | 1.0 part |
| Phosphate ester (melting point: 70° C.) | 4.0 parts |
| Zinc stearate (melting point: 115 to 125° C.) | 2.0 parts |
| Talc (mean particle diameter: 1.0 μm) | 1.0 part |
| Talc (mean particle diameter: 2.5 μm) | 4.0 parts |
| 2,6-Tolylene diisocyanate prepolymer | 5.0 parts |
| Toluene | 49.5 parts |
| Methyl ethyl ketone | 20.0 parts |
| Ethyl acetate | 5.0 parts |

<Production of Transfer-Target Object>

A transfer-target object for heat-sensitive transfer was produced by using a method similar to the method in Examples corresponding to Embodiment I in (I) above and Comparative Examples thereof.

<Measurement of Surface Roughness Ra>

A measuring method using laser microscopy, which is a non-contact type measuring method, was used. As a measuring device, a scanning confocal laser microscope "OLS1100" manufactured by Olympus (K.K.) was used. A 100× objective lens was selected. A measured image was divided into eleven in the Y-axis direction, and measurements of Ra value were each performed at a position that became a boundary with the division, using a cutoff value of ⅓ in the X-axis direction. Ra values from the obtained ten points were averaged to obtain an Ra value of the heat-resistant slippage layer. The average value α was a value obtained before the heat-resistant slippage layer was left still at 150° C. for 10 minutes, and the average value β was a value obtained after the heat-resistant slippage layer was left still with that condition. In addition, the difference between the average value α and the average value β was also calculated. The results are shown in Table 2.

<Evaluation of Adhesion of Dye Layer>

For each of the heat-sensitive transfer recording media of Examples II-1 to II-7 and Comparative Examples II-1 to II-10, a cellophane tape having a width of 24 mm and a length of 150 mm was adhered to the dye layer of the heat-sensitive transfer recording medium, and then peeled off immediately. Adhesion of the dye layer was evaluated by inspecting whether or not the dye layer had adhered to the cellophane tape side. The results are shown in Table 2.

Evaluation of adhesion of the dye layer was performed using the following criteria.

○: Adhesion of the dye layer is not observed.

Δ: Very slight adhesion of the dye layer is observed.

x: Adhesion of the dye layer is observed on the whole surface.

It should be noted that Δ or better is the level that is not a problem for practical use.

<Print Evaluation>

For each of the heat-sensitive transfer recording media of Examples II-1 to II-7 and Comparative Examples II-1 to II-10, print evaluation was conducted by overlaying a dye layer surface and a transfer-target object, conducting image formation by transferring a dye using a thermal head, and measuring the highest reflection density. The results are shown in Table 2. It should be noted that the highest reflection density is a value measured with a spectrodensitometer "X-rite 528" manufactured by X-rite Inc.

<Abnormal Transfer>

Abnormal transfer was evaluated using the following criteria for the heat-sensitive transfer recording media of Examples II-1 to II-7 and Comparative Examples II-1 to II-10. The results are shown in Table 2.

○: Abnormal transfer to the transfer-target object is not observed.

Δ: Very slight abnormal transfer to the transfer-target object is observed.

x: Abnormal transfer to the transfer-target object is observed on the whole surface.

It should be noted that Δ or better is the level that is not a problem for practical use.

<Print Wrinkles>

Print wrinkles of the heat-sensitive transfer recording media of Examples II-1 to II-7 and Comparative Examples II-1 to II-10 were evaluated using the following criteria. The results are shown in Table 2.

○: Print wrinkles are not observed.

Δ: Very slight print wrinkles are observed.

x: Print wrinkles are observed on the whole surface.

It should be noted that Δ or better is the level that is not a problem for practical use.

<Image Quality of Printed Object>

Image quality of printed objects was evaluated using the following criteria for the heat-sensitive transfer recording media of Examples II-1 to II-7 and Comparative Examples II-1 to II-10. The results are shown in Table 2.

○: No density unevenness and there is no problem in image quality.

x: Density unevenness is generated and there is a problem in image quality.

TABLE 2

| | | Average value α (μm) | Average value β (μm) | Difference between average value α and average value β (μm) | Highest reflection density | Adhesion of dye layer | Abnormal transfer | Print wrinkles | Image quality of printed objects |
|---|---|---|---|---|---|---|---|---|---|
| Example | II-1 | 0.31 | 0.55 | 0.24 | 2.51 | ○ | ○ | ○ | ○ |
| | II-2 | 0.31 | 0.54 | 0.23 | 2.58 | Δ | Δ | ○ | ○ |
| | II-3 | 0.31 | 0.57 | 0.26 | 2.43 | ○ | ○ | ○ | ○ |
| | II-4 | 0.31 | 0.53 | 0.22 | 2.51 | Δ | Δ | ○ | ○ |
| | II-5 | 0.31 | 0.55 | 0.24 | 2.43 | ○ | ○ | ○ | ○ |
| | II-6 | 0.46 | 0.58 | 0.12 | 2.52 | ○ | ○ | ○ | ○ |
| | II-7 | 0.07 | 0.25 | 0.18 | 2.55 | ○ | ○ | Δ | ○ |
| Comparative Example | II-1 | 0.31 | 0.57 | 0.26 | 1.81 | ○ | ○ | ○ | ○ |
| | II-2 | 0.31 | 0.54 | 0.23 | 1.96 | ○ | ○ | ○ | ○ |
| | II-3 | 0.31 | 0.55 | 0.24 | 1.97 | ○ | ○ | ○ | ○ |
| | II-4 | 0.31 | 0.53 | 0.22 | 1.92 | ○ | ○ | ○ | ○ |
| | II-5 | 0.31 | 0.53 | 0.22 | unmeasurable | Δ | x | ○ | ○ |
| | II-6 | 0.31 | 0.55 | 0.24 | 1.97 | ○ | ○ | ○ | ○ |
| | II-7 | 0.31 | 0.52 | 0.21 | 2.14 | ○ | ○ | ○ | ○ |
| | II-8 | 0.03 | 0.26 | 0.23 | 2.53 | ○ | ○ | x | ○ |
| | II-9 | 0.56 | 0.78 | 0.22 | 2.44 | ○ | ○ | ○ | x |
| | II-10 | 0.29 | 0.63 | 0.34 | 2.48 | ○ | ○ | x | ○ |

From the results shown in Table 2, when compared to the heat-sensitive transfer recording medium of Comparative Example II-1 not provided with an undercoating layer, it was shown that the heat-sensitive transfer recording media of Examples II-1 to II-7 clearly had high transfer sensitivity (highest reflection density) during high-speed printing, and a large cost-cutting effect through reduction of dye used in a dye layer. It was also shown that there were no problems for practical use in adhesion with a dye layer, abnormal transfer during printing, print wrinkles, and image quality of printed objects.

The heat-sensitive transfer recording medium of Example II-2 had a content ratio of polyvinyl alcohol and polyvinyl pyrrolidone on mass basis of polyvinyl alcohol/polyvinyl pyrrolidone=8/2, and, possibly because of a low polyvinyl pyrrolidone ratio, the heat-sensitive transfer recording medium resulted in slightly reduced adhesion with a dye layer and very slight abnormal transfer but not at a level causing a problem for practical use when compared to the heat-sensitive transfer recording medium of Example II-1.

The heat-sensitive transfer recording medium of Example II-3 had a content ratio of polyvinyl alcohol and polyvinyl pyrrolidone on mass basis of polyvinyl alcohol/polyvinyl pyrrolidone=3/7, and, possibly because of a low polyvinyl alcohol ratio, the heat-sensitive transfer recording medium resulted in slightly reduced transfer sensitivity when compared to the heat-sensitive transfer recording medium of Example II-1.

Heat-sensitive transfer recording medium of Example II-4 resulted in slightly reduced adhesion with a dye layer and very slight abnormal transfer but not at a level causing a problem for practical use when compared to the heat-sensitive transfer recording medium of Example II-1, possibly because the applied amount of the undercoating layer was less than 0.05 g/m$^2$.

The heat-sensitive transfer recording medium of Example II-5 resulted in slightly reduced transfer sensitivity when compared to the heat-sensitive transfer recording medium of Example II-1, possibly because the applied amount of the undercoating layer was more than 0.30 g/m$^2$.

The heat-sensitive transfer recording medium of Example II-7 resulted in very small levels of print wrinkles but not at a level causing problem for practical use, possibly because the average value α of surface roughness Ra of the heat-resistant slippage layer was slightly small as 0.07 μm.

On the other hand, as a result of using polyvinyl alcohol whose tensile strength measured based on JIS K 7113 was lower than 8 kg/mm$^2$, the heat-sensitive transfer recording medium of Comparative Example II-2 resulted in significantly reduced transfer sensitivity when compared to the heat-sensitive transfer recording medium of Example II-1.

The heat-sensitive transfer recording medium of Comparative Example II-3 whose dye layer was formed of a dye not containing an anthraquinone compound resulted in significantly reduced transfer sensitivity when compared to the heat-sensitive transfer recording medium of Example II-1.

The heat-sensitive transfer recording medium of Comparative Example II-4 in which polyvinyl alcohol having a tensile strength lower than 8 kg/mm$^2$ measured based on JIS K 7113 was used, and whose dye layer was formed of a dye not containing an anthraquinone compound resulted in further reduced transfer sensitivity when compared to the heat-sensitive transfer recording media of Comparative Examples II-2 and II-3. When transfer sensitivities were compared between Comparative Example II-3 in which polyvinyl alcohol having a tensile strength not lower than 8 kg/mm$^2$ measured based on JIS K 7113 was used, and Comparative Example II-4 in which polyvinyl alcohol having a tensile strength lower than 8 kg/mm$^2$ was used; the difference was small, and it was shown that the effect of tensile strength of polyvinyl alcohol on transfer sensitivity was small when a dye layer formed of a dye not containing an anthraquinone compound was used. From this, it was shown that dramatically high transfer sensitivity was obtained by using polyvinyl alcohol having a tensile strength not lower than 8 kg/mm$^2$ measured based on JIS K 7113, and using a thermal migratory dye containing an anthraquinone compound in a dye layer.

In the heat-sensitive transfer recording medium of Comparative Example II-5, as a result of applying and then drying an undercoating layer-forming application liquid containing only polyvinyl alcohol to form an undercoating layer; adhesion with a dye layer was reduced and abnormal transfer was observed on the whole surface when compared to the heat-sensitive transfer recording medium of the Example II-1.

In the heat-sensitive transfer recording medium of Comparative Example II-6, as a result of applying and then drying an undercoating layer-forming application liquid containing only polyvinyl pyrrolidone to form an undercoating layer; although there were no problems regarding adhesion with a dye layer, transfer sensitivity was significantly reduced when compared to the heat-sensitive transfer recording medium of Example II-1.

In the heat-sensitive transfer recording medium of Comparative Example II-7, PVA-117 (manufactured by Kuraray (K.K.)), which is a commercially available product, was used as polyvinyl alcohol for an undercoating layer. Since the tensile strength of the PVA-117 measured based on JIS K 7113 was lower than 8 kg/mm$^2$, the heat-sensitive transfer recording medium of Comparative Example II-7 resulted in low transfer sensitivity and was not sufficiently satisfactory when compared to the heat-sensitive transfer recording media of Examples II-1 to II-7 in which polyvinyl alcohol having a tensile strength not lower than 8 kg/mm$^2$ was used.

The heat-sensitive transfer recording medium of Comparative Example II-8 resulted in print wrinkles observed on the whole surface since the average value α of surface roughness Ra of the heat-resistant slippage layer was smaller than 0.05 μm.

The heat-sensitive transfer recording medium of Comparative Example II-9 resulted in density unevenness on a printed object and an image quality problem since the average value α of surface roughness Ra of the heat-resistant slippage layer was larger than 0.50 μm, contrary to Comparative Example II-8.

The heat-sensitive transfer recording medium of Comparative Example II-10 resulted in print wrinkles observed on the whole surface since the difference between the average value α of surface roughness Ra of the heat-resistant slippage layer and the average value β of surface roughness Ra of the heat-resistant slippage layer after the heat-resistant slippage layer had been left still at 150° C. for 10 minutes, was larger than 0.30 μm.

(III) Embodiment III

Examples corresponding to the Heat-Sensitive Transfer Recording Medium III and Comparative Examples Thereof <Production of Base Material with Heat-Resistant Slippage Layer>

A base material with a heat-resistant slippage layer was obtained by using a method similar to the method in Examples corresponding to Embodiment I in (I) above and Comparative Examples thereof.

<Preparation of Polyvinyl Alcohol>

By using a method similar to the method in Examples corresponding to Embodiment I in (I) above and Comparative Examples thereof, polyvinyl alcohol having a degree of saponification of 94 mol % and an average degree of polymerization of 2200, and polyvinyl alcohol having a degree of saponification of 88 mol % and an average degree of polymerization of 2200 were obtained.

<Tensile Strength Measurement of Polyvinyl Alcohol Film>

Tensile strength was measured by using a method similar to the method in Examples corresponding to Embodiment I in (I) above and Comparative Examples thereof. The resulting values were 8.2 kg/mm$^2$ for the polyvinyl alcohol having a degree of saponification of 94 mol % and an average degree of polymerization of 2200, and 6.8 kg/mm$^2$ for the polyvinyl alcohol having a degree of saponification of 88 mol % and an average degree of polymerization of 2200, and 7.4 kg/mm$^2$ for Kuraray Poval PVA-117.

Example III-1

On the adhesion-eased surface of the base material with the heat-resistant slippage layer, an undercoating layer-forming application liquid III-1 having the following composition was applied through gravure coating such that the applied amount after drying was 0.20 g/m$^2$, and the base material was dried at 100° C. for 2 minutes to form an undercoating layer. Then, on the undercoating layer, a dye layer-forming application liquid III-1 having the following composition was applied through gravure coating such that the applied amount after drying was 0.70 g/m$^2$, dried at 90° C. for 1 minute to form a dye layer, and a heat-sensitive transfer recording medium of Example III-1 was obtained.

<Undercoating Layer-Forming Application Liquid III-1>

| | |
|---|---|
| Polyvinyl alcohol (tensile strength: 8.2 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

<Dye Layer-Forming Application Liquid III-1>

| | |
|---|---|
| Silicone filler particle (volume average particle diameter: 2.0 μm) | 0.2 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Example III-2

A heat-sensitive transfer recording medium of Example III-2 was obtained in a manner similar to Example III-1, except for forming an undercoating layer using an undercoating layer-forming application liquid III-2 having the following composition in the heat-sensitive transfer recording medium produced in Example III-1.

<Undercoating Layer-Forming Application Liquid III-2>

| | |
|---|---|
| Polyvinyl alcohol (tensile strength: 8.2 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Example III-3

A heat-sensitive transfer recording medium of Example III-3 was obtained in a manner similar to Example III-1, except for forming an undercoating layer using an undercoating layer-forming application liquid III-3 having the following composition in the heat-sensitive transfer recording medium produced in Example III-1.

<Undercoating Layer-Forming Application Liquid III-3>

| | |
|---|---|
| Polyvinyl alcohol (tensile strength: 8.2 kg/mm$^2$) | 1.5 parts |
| Polyvinyl pyrrolidone (homopolymer of N-vinyl-2-pyrrolidone) | 3.5 parts |
| Pure water | 57.0 parts |
| Isopropyl alcohol | 38.0 parts |

Example III-4

A heat-sensitive transfer recording medium of Example III-4 was obtained in a manner similar to Example III-1, except for setting the applied amount of the undercoating layer after drying to 0.03 g/m$^2$ in the heat-sensitive transfer recording medium produced in Example III-1.

Example III-5

A heat-sensitive transfer recording medium of Example III-5 was obtained in a manner similar to Example III-1, except for setting the applied amount of the undercoating layer after drying to 0.40 g/m$^2$ in the heat-sensitive transfer recording medium produced in Example III-1.

Example III-6

A heat-sensitive transfer recording medium of Example III-6 was obtained in a manner similar to Example III-1, except for forming a dye layer using a dye layer-forming application liquid III-2 having the following composition in the heat-sensitive transfer recording medium produced in Example III-1.

<Dye Layer-Forming Application Liquid III-2>

| | |
|---|---|
| Silicone filler particle (volume average particle diameter: 0.7 μm) | 0.04 parts |
| C.I. Solvent blue 63 (anthraquinone dye) | 6.0 parts |
| Polyvinyl acetal | 4.0 parts |
| Toluene | 44.98 parts |
| Methyl ethyl ketone | 44.98 parts |

Example III-7

A heat-sensitive transfer recording medium of Example III-7 was obtained in a manner similar to Example III-1, except for forming a dye layer using a dye layer-forming application liquid III-3 having the following composition in the heat-sensitive transfer recording medium produced in Example III-1.

<Dye Layer-Forming Application Liquid III-3>

| | |
|---|---|
| Silicone filler particle (volume average particle diameter: 2.0 μm) | 0.3 parts |
| C.I. Solvent blue 63 (anthraquinone dye) | 6.0 parts |
| Polyvinyl acetal | 4.0 parts |
| Toluene | 44.85 parts |
| Methyl ethyl ketone | 44.85 parts |

Comparative Example III-1

A heat-sensitive transfer recording medium of Comparative Example III-1 was obtained in a manner similar to Example III-1, except for not forming an undercoating layer in the heat-sensitive transfer recording medium produced in Example III-1.

Comparative Example III-2

A heat-sensitive transfer recording medium of Comparative Example III-2 was obtained in a manner similar to Example III-1, except for forming an undercoating layer using an undercoating layer-forming application liquid III-4 having the following composition in the heat-sensitive transfer recording medium produced in Example III-1.

<Undercoating Layer-Forming Application Liquid III-4>

| | |
|---|---|
| Polyvinyl alcohol (tensile strength: 6.8 kg/mm$^2$ | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

Comparative Example III-3

A heat-sensitive transfer recording medium of Comparative Example III-3 was obtained in a manner similar to Example III-1, except for forming a dye layer using a dye layer-forming application liquid III-4 having the following composition in the heat-sensitive transfer recording medium produced in Example III-1.

<Dye Layer-Forming Application Liquid III-4>

| | |
|---|---|
| Silicone filler particle (volume average particle diameter: 2.0 μm) | 0.2 parts |
| C.I. Solvent blue 266 (azo dye) | 6.0 parts |
| Polyvinyl acetal | 4.0 parts |
| Toluene | 44.9 parts |
| Methyl ethyl ketone | 44.9 parts |

Comparative Example III-4

A heat-sensitive transfer recording medium of Comparative Example III-4 was obtained in a manner similar to Example III-1, except for forming an undercoating layer using the undercoating layer-forming application liquid III-4 and forming a dye layer using the dye layer-forming application liquid III-4 in the heat-sensitive transfer recording medium produced in Example III-1.

Comparative Example III-5

A heat-sensitive transfer recording medium of Comparative Example III-5 was obtained in a manner similar to Example III-1, except for forming an undercoating layer using an undercoating layer-forming application liquid III-5 having the following composition in the heat-sensitive transfer recording medium produced in Example III-1.

<Undercoating Layer-Forming Application Liquid III-5>

| | |
|---|---|
| Polyvinyl alcohol (tensile strength: 8.2 kg/mm$^2$) | 5.0 parts |
| Pure water | 57.0 parts |
| Isopropyl alcohol | 38.0 parts |

Comparative Example III-6

A heat-sensitive transfer recording medium of Comparative Example III-6 was obtained in a manner similar to Example III-1, except for forming an undercoating layer using an undercoating layer-forming application liquid III-6 having the following composition in the heat-sensitive transfer recording medium produced in Example III-1.

<Undercoating Layer-Forming Application Liquid III-6>

| | |
|---|---|
| Polyvinyl pyrrolidone (homopolymer of N-vinyl-2-pyrrolidone) | 5.0 parts |
| Pure water | 57.0 parts |
| Isopropyl alcohol | 38.0 parts |

Comparative Example III-7

A heat-sensitive transfer recording medium of Comparative Example III-7 was obtained in a manner similar to Example III-1, except for forming an undercoating layer using an undercoating layer-forming application liquid III-7 having the following composition in the heat-sensitive transfer recording medium produced in Example III-1.

<Undercoating Layer-Forming Application Liquid III-7>

| | |
|---|---|
| Polyvinyl alcohol (PVA-117 manufactured by Kuraray (K.K.), tensile strength: 7.4 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Comparative Example III-8

A heat-sensitive transfer recording medium of Comparative Example III-8 was obtained in a manner similar to Example III-1, except for forming a dye layer using a dye layer-forming application liquid III-5 having the following composition in the heat-sensitive transfer recording medium produced in Example III-1.

<Dye Layer-Forming Application Liquid III-5>

| | |
|---|---|
| C.I. Solvent blue 63 (anthraquinone dye) | 6.0 parts |
| Polyvinyl acetal | 4.0 parts |
| Toluene | 45.0 parts |
| Methyl ethyl ketone | 45.0 parts |

Comparative Example III-9

A heat-sensitive transfer recording medium of Comparative Example III-9 was obtained in a manner similar to Example III-1, except for forming a dye layer using a dye layer-forming application liquid III-6 having the following composition in the heat-sensitive transfer recording medium produced in Example III-1.

<Dye Layer-Forming Application Liquid III-6>

| | |
|---|---|
| Silicone filler particle (volume average particle diameter: 0.7 μm) | 0.02 parts |
| C.I. Solvent blue 63 (anthraquinone dye) | 6.0 parts |
| Polyvinyl acetal | 4.0 parts |
| Toluene | 44.99 parts |
| Methyl ethyl ketone | 44.99 parts |

Comparative Example III-10

A heat-sensitive transfer recording medium of Comparative Example III-10 was obtained in a manner similar to Example III-1, except for forming a dye layer using a dye layer-forming application liquid III-7 having the following composition in the heat-sensitive transfer recording medium produced in Example III-1.

<Dye Layer-Forming Application Liquid III-7>

| | |
|---|---|
| Silicone filler particle (volume average particle diameter: 2.0 μm) | 0.4 parts |
| C.I. Solvent blue 63 (anthraquinone dye) | 6.0 parts |
| Polyvinyl acetal | 4.0 parts |
| Toluene | 44.8 parts |
| Methyl ethyl ketone | 44.8 parts |

Comparative Example III-11

A heat-sensitive transfer recording medium of Comparative Example III-11 was obtained in a manner similar to Example III-1, except for forming a dye layer using a dye layer-forming application liquid III-8 having the following composition in the heat-sensitive transfer recording medium produced in Example III-1.

<Dye Layer-Forming Application Liquid III-8>

| | |
|---|---|
| Silicone filler particle (volume average particle diameter: 0.02 μm) | 0.2 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example III-12

A heat-sensitive transfer recording medium of Comparative Example III-12 was obtained in a manner similar to Example III-1, except for forming a dye layer using a dye layer-forming application liquid III-9 having the following composition in the heat-sensitive transfer recording medium produced in Example III-1.

<Dye Layer-Forming Application Liquid III-9>

| | |
|---|---|
| Silicone filler particle (volume average particle diameter: 5.0 μm) | 0.2 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

It should be noted that the volume average particle diameter of silicone filler particles was measured through laser diffraction/dispersion method using a diameter distribution measuring device for nano particles "SALD7100" manufactured by Shimadzu (K.K.).

<Production of Thermal Transfer Image-Receiving Sheet>

A base material with an aqueous hollow particle layer was obtained by using an art paper having a basis weight of 180 g/m$^2$ as a base material, and applying, on the base material, an aqueous hollow particle layer-forming application liquid having the following composition using gravure coating such that the applied amount after drying was 10 g/m$^2$, drying the base material, and aging the base material at 40° C. for 1 week.

<Aqueous Hollow Particle Layer-Forming Application Liquid>

| | |
|---|---|
| Foamed hallow particle (volume average particle diameter: 3.2 μm, volume hollow rate 85%) consisting of a copolymer whose main components are acrylonitrile and methacrylonitrile | 45.0 parts |
| Polyvinyl alcohol | 10.0 parts |
| Vinyl chloride-vinyl acetate copolymer dispersion (vinyl chloride/vinyl acetate (mass ratio) = 70/30, glass transition temperature: 64° C.) | 45.0 parts |
| Water | 200.0 parts |

A thermal transfer image-receiving sheet was obtained by applying, on the aqueous hallow particle layer, an aqueous-receiving layer-forming application liquid having the following composition using gravure coating such that the applied amount after drying was 4 g/m$^2$, drying the base material, and aging the base material at 40° C. for 1 week to form an aqueous-receiving layer.

<Aqueous-Receiving Layer-Forming Application Liquid>

| | |
|---|---|
| Urethane resin (glass transition temperature: −20° C.) | 96.0 parts |
| Aggregation type urethane thickener | 1.0 part |
| Sulfonic acid surfactant | 2.0 parts |
| Silicone oil | 1.0 part |
| Water | 200.0 parts |

<Evaluation of Adhesion of Dye Layer>

For each of the heat-sensitive transfer recording media of Examples III-1 to III-7 and Comparative Examples III-1 to III-12, a cellophane tape having a width of 24 mm and a length of 150 mm was adhered to the dye layer of the heat-sensitive transfer recording medium, and then peeled off immediately. Adhesion of the dye layer was evaluated by inspecting whether or not the dye layer had adhered to the cellophane tape side. The results are shown in Table 3.

Evaluation of adhesion of the dye layer was performed using the following criteria.

○: Adhesion of the dye layer is not observed.

Δ: Very slight adhesion of the dye layer is observed.

x: Adhesion of the dye layer is observed on the whole surface.

It should be noted that Δ or better is the level that is not a problem for practical use.

<Measurement of Three-Dimensional Surface Roughness (SRa) of Dye Layer>

For each of the heat-sensitive transfer recording media of Examples III-1 to III-7 and Comparative Examples III-1 to III-12, the three-dimensional surface roughness (SRa) of a dye layer of a heat-sensitive transfer recording medium was measured using a scanning confocal laser microscope "OLS1100" manufactured by Olympus (K.K.) with the following conditions. The results are shown in Table 3. The measurement and analysis conditions are shown below.

Scanning direction: MD direction of sample.

Measurement length: X-direction 128 μm, Y-direction 128 μm.

Cutoff value: ⅓.

<Print Evaluation>

Print evaluation was conducted through solid-printing with a thermal simulator using the heat-sensitive transfer recording media of Examples III-1 to III-7 and Comparative Examples III-1 to III-12, and measuring the highest reflection density. The results are shown in Table 3. It should be noted that the highest reflection density is a value measured with a spectrodensitometer "X-rite 528" manufactured by X-rite Inc.

The following printing conditions were used.

Printing environment: 23° C., 50% RH.

Applied voltage: 29 V.

Line period: 0.7 msec.

Print density: Horizontal scanning of 300 dpi, vertical scanning of 300 dpi.

<Abnormal Transfer>

Abnormal transfer was evaluated using the following criteria for the heat-sensitive transfer recording media of Examples III-1 to III-7 and Comparative Examples III-1 to III-12. The results are shown in Table 3.

○: Abnormal transfer to the transfer-target object is not observed.

Δ: Very slight abnormal transfer to the transfer-target object is observed.

x: Abnormal transfer to the transfer-target object is observed on the whole surface.

It should be noted that Δ or better is the level that is not a problem for practical use.

<Shade Unevenness Generated at High Density Part>

Shade unevenness generated at a high density part was evaluated using the following criteria for the heat-sensitive transfer recording media of Examples III-1 to III-7 and Comparative Examples III-1 to III-12. The results are shown in Table 3.

○: Shade unevenness is not observed at high density part.

Δ: Shade unevenness is slightly observed at high density part.

x: Shade unevenness is clearly observed at high density part.

It should be noted that Δ or better is the level that is not a problem for practical use.

TABLE 3

| | Highest reflection density | Adhesion of dye layer | Abnormal transfer | Three-dimensional surface roughness of dye layer SRa (μm) | Shade unevenness generated at high density part |
|---|---|---|---|---|---|
| Example III-1 | 2.51 | ○ | ○ | 0.49 | ○ |
| III-2 | 2.56 | Δ | Δ | 0.51 | ○ |
| III-3 | 2.41 | ○ | ○ | 0.49 | ○ |
| III-4 | 2.51 | Δ | Δ | 0.47 | ○ |
| III-5 | 2.44 | ○ | ○ | 0.45 | ○ |
| III-6 | 2.53 | ○ | ○ | 0.16 | Δ |
| III-7 | 2.46 | ○ | Δ | 0.62 | ○ |
| Comparative Example III-1 | 1.83 | ○ | ○ | 0.52 | ○ |
| III-2 | 1.95 | ○ | ○ | 0.49 | ○ |
| III-3 | 1.99 | ○ | ○ | 0.5 | ○ |
| III-4 | 1.91 | ○ | ○ | 0.49 | ○ |
| III-5 | unmeasurable | Δ | x | 0.48 | ○ |
| III-6 | 1.98 | ○ | ○ | 0.5 | ○ |
| III-7 | 2.12 | ○ | ○ | 0.51 | ○ |
| III-8 | 2.52 | ○ | ○ | 0.1 | x |
| III-9 | 2.51 | ○ | ○ | 0.12 | x |
| III-10 | 2.15 | ○ | x | 0.77 | ○ |
| III-11 | 2.52 | ○ | ○ | 0.1 | x |
| III-12 | 2.1 | ○ | Δ | 0.85 | ○ |

From the results shown in Table 3, when compared to the heat-sensitive transfer recording medium of Comparative Example III-1 not provided with an undercoating layer, it was shown that the heat-sensitive transfer recording media of Examples III-1 to III-7 clearly had high transfer sensitivity during high-speed printing, and a large cost-cutting effect through reduction of dye used in a dye layer. It was also shown that there were no problems for practical use in adhesion with a dye layer, abnormal transfer during printing, and shade unevenness generated at a high density part.

The heat-sensitive transfer recording medium of Example III-2 had a content ratio of polyvinyl alcohol and polyvinyl pyrrolidone on mass basis of polyvinyl alcohol/polyvinyl pyrrolidone=8/2, and, possibly because of a low polyvinyl pyrrolidone ratio, the heat-sensitive transfer recording medium resulted in slightly reduced adhesion with a dye layer when compared to the heat-sensitive transfer recording medium of Example III-1.

The heat-sensitive transfer recording medium of Example III-3 had a content ratio of polyvinyl alcohol and polyvinyl pyrrolidone on mass basis of polyvinyl alcohol/polyvinyl pyrrolidone=3/7, and, possibly because of a low polyvinyl alcohol ratio, the heat-sensitive transfer recording medium resulted in slightly reduced transfer sensitivity (highest reflection density) when compared to the heat-sensitive transfer recording medium of Example III-1.

The heat-sensitive transfer recording medium of Example III-4 resulted in slightly reduced adhesion with a dye layer when compared to the heat-sensitive transfer recording medium of Example III-1, possibly because the applied amount of the undercoating layer was less than 0.05 g/m$^2$.

The heat-sensitive transfer recording medium of Example III-5 resulted in slightly reduced transfer sensitivity when compared to the heat-sensitive transfer recording medium of Example III-1, possibly because the applied amount of the undercoating layer was more than 0.30 g/m$^2$.

The heat-sensitive transfer recording medium of Example III-6 resulted in slight shade unevenness observed at a high density part when compared to the heat-sensitive transfer recording media of Examples III-1 to III-5, and 111-7, possibly because the three-dimensional surface roughness (SRa) of the dye layer was small.

Possibly because SRa of the dye layer was large, the heat-sensitive transfer recording medium of Example III-7 had slightly reduced transfer sensitivity when compared to the heat-sensitive transfer recording medium of Example III-1, although shade unevenness was prevented from occurring at the high density part.

On the other hand, as a result of using polyvinyl alcohol whose tensile strength measured based on JIS K 7113 was lower than 8 kg/mm$^2$, the heat-sensitive transfer recording medium of Comparative Example III-2 resulted in significantly reduced transfer sensitivity when compared to the heat-sensitive transfer recording medium of Example III-1.

The heat-sensitive transfer recording medium of Comparative Example III-3 whose dye layer was formed of a dye not containing an anthraquinone compound resulted in significantly reduced transfer sensitivity when compared to the heat-sensitive transfer recording medium of Example III-1.

The heat-sensitive transfer recording medium of Comparative Example III-4 in which polyvinyl alcohol having a tensile strength lower than 8 kg/mm$^2$ measured based on JIS K 7113 was used, and whose dye layer was formed of a dye not containing an anthraquinone compound had further reduced transfer sensitivity when compared to the heat-sensitive transfer recording media of Comparative Examples III-2 and III-3. When transfer sensitivities were compared between Comparative Example III-3 in which polyvinyl alcohol having a tensile strength not lower than 8 kg/mm$^2$ measured based on JIS K 7113 was used, and Comparative Example III-4 in which polyvinyl alcohol having a tensile strength lower than 8 kg/mm$^2$ was used; the difference was small, and it was shown that the effect of tensile strength of polyvinyl alcohol on transfer sensitivity was small when a dye layer formed of a dye not containing an anthraquinone compound was used. From this, it was shown that dramatically high transfer sensitivity was obtained by using polyvinyl alcohol having a tensile strength not lower than 8 kg/mm$^2$ measured based on JIS K 7113, and using a thermal migratory dye containing an anthraquinone compound in a dye layer.

In the heat-sensitive transfer recording medium of Comparative Example III-5, as a result of applying and then drying an undercoating layer-forming application liquid containing only polyvinyl alcohol to form an undercoating layer; adhesion with a dye layer was reduced and abnormal transfer was observed on the whole surface when compared to the heat-sensitive transfer recording medium of the Example III-1.

In the heat-sensitive transfer recording medium of Comparative Example III-6, as a result of applying and then drying an undercoating layer-forming application liquid containing only polyvinyl pyrrolidone to form an undercoating layer; although there were no problems regarding adhesion with a dye layer, transfer sensitivity was significantly reduced when compared to the heat-sensitive transfer recording medium of Example III-1.

In the heat-sensitive transfer recording medium of Comparative Example III-7, PVA-117 (manufactured by Kuraray (K.K.)), which is a commercially available product, was used as polyvinyl alcohol for an undercoating layer. Since the tensile strength of the PVA-117 measured based on JIS K 7113 was lower than 8 kg/mm$^2$, the heat-sensitive transfer recording medium of Comparative Example III-7 resulted in low transfer sensitivity and was not sufficiently satisfactory when compared to the heat-sensitive transfer recording media of Examples III-1 to III-7 in which polyvinyl alcohol having a tensile strength not lower than 8 kg/mm$^2$ was used.

Since the heat-sensitive transfer recording medium of Comparative Example III-8 did not contain filler particles in the dye layer, SRa was 0.10 μm and the dye layer surface was extremely flat, and thermal fusion bonding occurred during printing and shade unevenness was confirmed clearly at the high density part.

Although the heat-sensitive transfer recording medium of Comparative Example III-9 contained filler particles in the dye layer, since the SRa was smaller than 0.15 μm and the dye layer surface was too flat, it was not possible to sufficiently prevent shade unevenness from occurring at the high density part.

Since the heat-sensitive transfer recording medium of Comparative Example III-10 had too much of the filler particles in the dye layer and had an SRa larger than 0.7 μm, the heat-sensitive transfer recording medium resulted in reduced transfer sensitivity and abnormal transfer.

Since the heat-sensitive transfer recording medium of the Comparative Example III-11 had a volume average particle diameter for the filler particles in the dye layer as small as 0.02 μm and the SRa was smaller than 0.15 μm, it was not possible to sufficiently prevent shade unevenness from occurring at the high density part.

Since the heat-sensitive transfer recording medium of Comparative Example III-12 had a volume average particle diameter of filler particles in the dye layer as large as 5.0 μm and had an SRa larger than 0.70 μm, the heat-sensitive transfer recording medium had reduced transfer sensitivity. When the heat-sensitive transfer recording medium was observed through optical microscopy after printing, filler particles were observed to have slipped and dropped from the dye layer.

(IV) Embodiment IV

Examples corresponding to the Heat-Sensitive Transfer Recording Medium IV and Comparative Examples Thereof <Production of Base Material with Heat-Resistant Slippage Layer>

A base material with a heat-resistant slippage layer was obtained by using a method similar to the method in Examples corresponding to Embodiment I in (I) above and Comparative Examples thereof.

<Preparation of Polyvinyl Alcohol>

By using a method similar to the method in Examples corresponding to Embodiment I in (I) above and Comparative Examples thereof, polyvinyl alcohol having a degree of saponification of 94 mol % and an average degree of polymerization of 2200, and polyvinyl alcohol having a degree of saponification of 88 mol % and an average degree of polymerization of 2200 were obtained.

<Tensile Strength Measurement of Polyvinyl Alcohol Film>

Tensile strength was measured by using a method similar to the method in Examples corresponding to Embodiment I in (I) above and Comparative Examples thereof. The resulting values were 8.2 kg/mm$^2$ for the polyvinyl alcohol having a degree of saponification of 94 mol % and an average degree of polymerization of 2200, and 6.8 kg/mm$^2$ for the polyvinyl alcohol having a degree of saponification of 88 mol % and an average degree of polymerization of 2200, and 7.4 kg/mm$^2$ for Kuraray Poval PVA-117.

Example IV-1

On the adhesion-eased surface of the base material with the heat-resistant slippage layer, an undercoating layer-forming application liquid IV-1 having the following composition was applied through gravure coating such that the applied amount after drying was 0.20 g/m$^2$, and the base material was dried at 100° C. for 2 minutes to form an undercoating layer. Then, on the undercoating layer, a dye layer-forming application liquid IV-1 having the following composition was applied through gravure coating such that the applied amount after drying was 0.70 g/m$^2$, dried at 90° C. for 1 minute to form a dye layer, and a heat-sensitive transfer recording medium of Example IV-1 was obtained.

<Undercoating Layer-Forming Application Liquid IV-1>

| | |
|---|---|
| Polyvinyl alcohol (tensile strength: 8.2 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

<Dye Layer-Forming Application Liquid IV-1>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.); glass transition temperature: 110° C.) | 3.6 parts |
| Polyvinyl butyral (Denka Butyral #3000-1 manufactured by Denki Kagaku Kogyo (K.K.), glass transition temperature: 68° C.) | 0.4 parts |
| Toluene | 45.0 parts |
| Methyl ethyl ketone | 45.0 parts |

Example IV-2

A heat-sensitive transfer recording medium of Example IV-2 was obtained in a manner similar to Example IV-1, except for forming an undercoating layer using an undercoating layer-forming application liquid IV-2 having the following composition in the heat-sensitive transfer recording medium produced in Example IV-1.

<Undercoating Layer-Forming Application Liquid IV-2>

| | |
|---|---|
| Polyvinyl alcohol (tensile strength: 8.2 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Example IV-3

A heat-sensitive transfer recording medium of Example IV-3 was obtained in a manner similar to Example IV-1, except for forming an undercoating layer using an undercoating layer-forming application liquid IV-3 having the following composition in the heat-sensitive transfer recording medium produced in Example IV-1.

<Undercoating Layer-Forming Application Liquid IV-3>

| | |
|---|---|
| Polyvinyl alcohol (tensile strength: 8.2 kg/mm$^2$) | 1.5 parts |
| Polyvinyl pyrrolidone (homopolymer of N-vinyl-2-pyrrolidone) | 3.5 parts |
| Pure water | 57.0 parts |
| Isopropyl alcohol | 38.0 parts |

Example IV-4

A heat-sensitive transfer recording medium of Example IV-4 was obtained in a manner similar to Example IV-1, except for setting the applied amount of the undercoating layer after drying to 0.03 g/m$^2$ in the heat-sensitive transfer recording medium produced in Example IV-1.

Example IV-5

A heat-sensitive transfer recording medium of Example IV-5 was obtained in a manner similar to Example IV-1, except for setting the applied amount of the undercoating layer after drying to 0.40 g/m$^2$ in the heat-sensitive transfer recording medium produced in Example IV-1.

Example IV-6

A heat-sensitive transfer recording medium of Example IV-6 was obtained in a manner similar to Example IV-1, except for forming a dye layer using a dye layer-forming application liquid IV-2 having the following composition in the heat-sensitive transfer recording medium produced in Example IV-1.

<Dye Layer-Forming Application Liquid IV-2>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.), glass transition temperature: 110° C.) | 3.8 parts |

-continued

| | |
|---|---|
| Polyvinyl butyral (Denka Butyral #3000-1 manufactured by Denki Kagaku Kogyo (K.K.), glass transition temperature: 68° C.) | 0.2 parts |
| Toluene | 45.0 parts |
| Methyl ethyl ketone | 45.0 parts |

Example IV-7

A heat-sensitive transfer recording medium of Example IV-7 was obtained in a manner similar to Example IV-1, except for forming a dye layer using a dye layer-forming application liquid IV-3 having the following composition in the heat-sensitive transfer recording medium produced in Example IV-1.

<Dye Layer-Forming Application Liquid IV-3>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.), glass transition temperature: 110° C.) | 3.92 parts |
| Polyvinyl butyral (Denka Butyral #3000-1 manufactured by Denki Kagaku Kogyo (K.K.), glass transition temperature: 68° C.) | 0.08 parts |
| Toluene | 45.0 parts |
| Methyl ethyl ketone | 45.0 parts |

Example IV-8

A heat-sensitive transfer recording medium of Example IV-8 was obtained in a manner similar to Example IV-1, except for forming a dye layer using a dye layer-forming application liquid IV-4 having the following composition in the heat-sensitive transfer recording medium produced in Example IV-1.

<Dye Layer-Forming Application Liquid IV-4>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.), glass transition temperature: 110° C.) | 2.0 parts |
| Polyvinyl butyral (Denka Butyral #3000-1 manufactured by Denki Kagaku Kogyo (K.K.), glass transition temperature: 68° C.) | 2.0 parts |
| Toluene | 45.0 parts |
| Methyl ethyl ketone | 45.0 parts |

Example IV-9

A heat-sensitive transfer recording medium of Example IV-9 was obtained in a manner similar to Example IV-1, except for forming a dye layer using a dye layer-forming application liquid IV-5 having the following composition in the heat-sensitive transfer recording medium produced in Example IV-1.

<Dye Layer-Forming Application Liquid IV-5>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.), glass transition temperature: 110° C.) | 1.6 parts |
| Polyvinyl butyral (Denka Butyral #3000-1 manufactured by Denki Kagaku Kogyo (K.K.), glass transition temperature: 68° C.) | 2.4 parts |

-continued

| | |
|---|---|
| Toluene | 45.0 parts |
| Methyl ethyl ketone | 45.0 parts |

Comparative Example IV-1

A heat-sensitive transfer recording medium of Comparative Example IV-1 was obtained in a manner similar to Example IV-1, except for not forming an undercoating layer in the heat-sensitive transfer recording medium produced in Example IV-1.

Comparative Example IV-2

A heat-sensitive transfer recording medium of Comparative Example IV-2 was obtained in a manner similar to Example IV-1, except for forming an undercoating layer using an undercoating layer-forming application liquid IV-4 having the following composition in the heat-sensitive transfer recording medium produced in Example IV-1.

<Undercoating Layer-Forming Application Liquid IV-4>

| | |
|---|---|
| Polyvinyl alcohol (tensile strength: 6.8 kg/mm$^2$ | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

Comparative Example IV-3

A heat-sensitive transfer recording medium of Comparative Example IV-3 was obtained in a manner similar to Example IV-1, except for forming a dye layer using a dye layer-forming application liquid IV-6 having the following composition in the heat-sensitive transfer recording medium produced in Example IV-1.

<Dye Layer-Forming Application Liquid IV-6>

| | |
|---|---|
| C.I. Solvent blue 266 (azo dye) | 6.0 parts |
| Polyvinyl acetal (Denka Butyral #5000-D manufactured by Denki Kagaku Kogyo (K.K.), glass transition temperature: 110° C.) | 3.6 parts |
| Polyvinyl butyral (Denka Butyral #3000-1 manufactured by Denki Kagaku Kogyo (K.K.), glass transition temperature: 68° C.) | 0.4 parts |
| Toluene | 45.0 parts |
| Methyl ethyl ketone | 45.0 parts |

Comparative Example IV-4

A heat-sensitive transfer recording medium of Comparative Example IV-4 was obtained in a manner similar to Example IV-1, except for forming an undercoating layer using the undercoating layer-forming application liquid IV-4 and forming a dye layer using the dye layer-forming application liquid IV-6 in the heat-sensitive transfer recording medium produced in Example IV-1.

Comparative Example IV-5

A heat-sensitive transfer recording medium of Comparative Example IV-5 was obtained in a manner similar to Example IV-1, except for forming an undercoating layer using an undercoating layer-forming application liquid IV-5 having the following composition in the heat-sensitive transfer recording medium produced in Example IV-1.

<Undercoating Layer-Forming Application Liquid IV-5>

| | |
|---|---|
| Polyvinyl alcohol (tensile strength: 8.2 kg/mm$^2$) | 5.0 parts |
| Pure water | 57.0 parts |
| Isopropyl alcohol | 38.0 parts |

Comparative Example IV-6

A heat-sensitive transfer recording medium of Comparative Example IV-6 was obtained in a manner similar to Example IV-1, except for forming an undercoating layer using an undercoating layer-forming application liquid IV-6 having the following composition in the heat-sensitive transfer recording medium produced in Example IV-1.

<Undercoating Layer-Forming Application Liquid IV-6>

| | |
|---|---|
| Polyvinyl pyrrolidone (homopolymer of N-vinyl-2-pyrrolidone) | 5.0 parts |
| Pure water | 57.0 parts |
| Isopropyl alcohol | 38.0 parts |

Comparative Example IV-7

A heat-sensitive transfer recording medium of Comparative Example IV-7 was obtained in a manner similar to Example IV-1, except for forming an undercoating layer using an undercoating layer-forming application liquid IV-7 having the following composition in the heat-sensitive transfer recording medium produced in Example IV-1.

<Undercoating Layer-Forming Application Liquid IV-7>

| | |
|---|---|
| Polyvinyl alcohol (PVA-117 manufactured by Kuraray (K.K.), tensile strength: 7.4 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Comparative Example IV-8

A heat-sensitive transfer recording medium of Comparative Example IV-8 was obtained in a manner similar to Example IV-1, except for forming a dye layer using a dye layer-forming application liquid IV-7 having the following composition in the heat-sensitive transfer recording medium produced in Example IV-1.

<Dye Layer-Forming Application Liquid IV-7>

| | |
|---|---|
| C.I. Solvent blue 63 (anthraquinone dye) | 6.0 parts |
| Polyvinyl butyral (Denka Butyral #3000-1 manufactured by Denki Kagaku Kogyo (K.K.), glass transition temperature: 68° C.) | 4.0 parts |
| Toluene | 45.0 parts |
| Methyl ethyl ketone | 45.0 parts |

Comparative Example IV-9

A heat-sensitive transfer recording medium of Comparative Example IV-9 was obtained in a manner similar to Example IV-1, except for forming a dye layer using a dye layer-forming application liquid IV-8 having the following composition in the heat-sensitive transfer recording medium produced in Example IV-1.

<Dye Layer-Forming Application Liquid IV-8>

| | |
|---|---|
| C.I. Solvent blue 63 (anthraquinone dye) | 6.0 parts |
| Polyvinyl acetal (Denka Butyral #5000-D manufactured by Denki Kagaku Kogyo (K.K.), glass transition temperature: 110° C.) | 4.0 parts |
| Toluene | 45.0 parts |
| Methyl ethyl ketone | 45.0 parts |

<Production of Transfer-Target Object>

A transfer-target object for heat-sensitive transfer was produced by using a method similar to the method in Examples corresponding to Embodiment I in (I) above and Comparative Examples thereof.

<Evaluation of Adhesion of Dye Layer>

For each of the heat-sensitive transfer recording media of Examples IV-1 to IV-9 and Comparative Examples IV-1 to IV-9, a cellophane tape having a width of 24 mm and a length of 150 mm was adhered to the dye layer of the heat-sensitive transfer recording medium, and then peeled off immediately. Adhesion of the dye layer was evaluated by inspecting whether or not the dye layer had adhered to the cellophane tape side. The results are shown in Table 4.

Evaluation of adhesion of the dye layer was performed using the following criteria.

○: Adhesion of the dye layer is not observed.

Δ: Very slight adhesion of the dye layer is observed.

x: Adhesion of the dye layer is observed on the whole surface.

It should be noted that Δ or better is the level that is not a problem for practical use.

<Print Evaluation>

By using the heat-sensitive transfer recording media of Examples IV-1 to IV-9 and Comparative Examples IV-1 to IV-9, solid-printing was conducted with a thermal simulator, and reflection density was evaluated in each tone range obtained by dividing 255 tones which was the highest reflection density into eleven. The results are shown in Table 5. It should be noted that transfer sensitivity at a low density part was evaluated using reflection density at a tone range of 23 to 46, and transfer sensitivity at a high density part was evaluated using reflection density at a tone of 255. Furthermore, reflection density was a value measured using spectrodensitometer "X-rite 528" manufactured by X-rite Inc.

The following printing conditions were used.

Printing environment: 23° C., 50% RH.

Applied voltage: 29 V.

Line period: 0.7 msec.

Print density: Horizontal scanning of 300 dpi, vertical scanning of 300 dpi.

<Abnormal Transfer>

Abnormal transfer was evaluated using the following criteria for the heat-sensitive transfer recording media of Examples IV-1 to IV-9 and Comparative Examples IV-1 to IV-9. The results are shown in Table 4.

○: Abnormal transfer to the transfer-target object is not observed.

Δ: Very slight abnormal transfer to the transfer-target object is observed.

x: Abnormal transfer to the transfer-target object is observed on the whole surface.

It should be noted that Δ or better is the level that is not a problem for practical use.

<Wrinkles>

Wrinkles were evaluated using the following criteria for the heat-sensitive transfer recording media of Examples IV-1 to IV-9 and Comparative Examples IV-1 to IV-9. The results are shown in Table 4.

○: Wrinkles are not observed on a transfer-target object.

Δ: Although wrinkles are almost not observed on a transfer-target object, deformation and elongation of the heat-sensitive transfer recording medium are slightly observed.

x: Wrinkles are observed on the whole surface of a transfer-target object.

It should be noted that Δ or better is the level that is not a problem for practical use.

TABLE 4

| | | Tensile strength of PVA (kg/mm$^2$) | Applied amount of undercoating layer after drying (g/m$^2$) | Thermal migratory dye in dye layer | PVAc/PVBu (mass basis) PVAc | PVBu | Evaluation Adhesion of dye layer | Abnormal transfer | Wrinkles |
|---|---|---|---|---|---|---|---|---|---|
| Example | IV-1 | 8.2 | 0.2 | S.B.63 | 90 | 10 | ○ | ○ | ○ |
| | IV-2 | 8.2 | 0.2 | S.B.63 | 90 | 10 | Δ | Δ | ○ |
| | IV-3 | 8.2 | 0.2 | S.B.63 | 90 | 10 | ○ | ○ | ○ |
| | IV-4 | 8.2 | 0.03 | S.B.63 | 90 | 10 | Δ | Δ | ○ |
| | IV-5 | 8.2 | 0.4 | S.B.63 | 90 | 10 | ○ | ○ | ○ |
| | IV-6 | 8.2 | 0.2 | S.B.63 | 95 | 5 | ○ | ○ | ○ |
| | IV-7 | 8.2 | 0.2 | S.B.63 | 98 | 2 | ○ | ○ | ○ |
| | IV-8 | 8.2 | 0.2 | S.B.63 | 50 | 50 | ○ | ○ | ○ |
| | IV-9 | 8.2 | 0.2 | S.B.63 | 40 | 60 | ○ | ○ | Δ |
| Comparative | IV-1 | — | — | S.B.63 | 90 | 10 | ○ | ○ | ○ |
| Example | IV-2 | 6.8 | 0.2 | S.B.63 | 90 | 10 | ○ | ○ | ○ |
| | IV-3 | 8.2 | 0.2 | S.B.266 | 90 | 10 | ○ | ○ | ○ |
| | IV-4 | 6.8 | 0.2 | S.B.266 | 90 | 10 | ○ | ○ | ○ |
| | IV-5 | 8.2 | 0.2 | S.B.63 | 90 | 10 | Δ | x | x |
| | IV-6 | 8.2 | 0.2 | S.B.63 | 90 | 10 | ○ | ○ | ○ |
| | IV-7 | 7.4 | 0.2 | S.B.63 | 90 | 10 | ○ | ○ | ○ |

TABLE 4-continued

| | Tensile strength of PVA (kg/mm$^2$) | Applied amount of undercoating layer after drying (g/m$^2$) | Thermal migratory dye in dye layer | PVAc/PVBu (mass basis) PVAc | PVBu | Evaluation Adhesion of dye layer | Abnormal transfer | Wrinkles |
|---|---|---|---|---|---|---|---|---|
| IV-8 | 8.2 | 0.2 | S.B.63 | 0 | 100 | ○ | ○ | x |
| IV-9 | 8.2 | 0.2 | S.B.63 | 100 | 0 | ○ | ○ | ○ |

Notes:
PVA: Polyvinyl alcohol
PVAc: Polyvinyl acetal
PVBu: Polyvinyl butyral
S.B.63: C.I. Solvent blue 63
S.B.266: C.I. Solvent blue 266

TABLE 5

| | | Reflection density at each tone Tone 0 | 23/255 | 46/255 | 70/255 | 93/255 | 116/255 | 139/255 | 162/255 | 185/255 | 209/255 | 232/255 | 255/255 |
|---|---|---|---|---|---|---|---|---|---|---|---|---|---|
| Example | IV-1 | 0.06 | 0.13 | 0.22 | 0.37 | 0.48 | 0.7 | 0.96 | 1.24 | 1.56 | 1.77 | 2.17 | 2.54 |
| | IV-2 | 0.06 | 0.13 | 0.22 | 0.37 | 0.48 | 0.69 | 0.95 | 1.23 | 1.54 | 1.75 | 2.14 | 2.58 |
| | IV-3 | 0.06 | 0.13 | 0.21 | 0.36 | 0.47 | 0.69 | 0.95 | 1.23 | 1.54 | 1.74 | 2.13 | 2.4 |
| | IV-4 | 0.06 | 0.14 | 0.23 | 0.38 | 0.48 | 0.69 | 0.95 | 1.23 | 1.54 | 1.75 | 2.14 | 2.52 |
| | IV-5 | 0.06 | 0.12 | 0.2 | 0.35 | 0.46 | 0.67 | 0.93 | 1.2 | 1.52 | 1.72 | 2.1 | 2.45 |
| | IV-6 | 0.06 | 0.12 | 0.2 | 0.36 | 0.47 | 0.68 | 0.94 | 1.22 | 1.53 | 1.73 | 2.12 | 2.51 |
| | IV-7 | 0.06 | 0.11 | 0.18 | 0.35 | 0.46 | 0.68 | 0.93 | 1.21 | 1.53 | 1.74 | 2.14 | 2.55 |
| | IV-8 | 0.06 | 0.13 | 0.23 | 0.39 | 0.49 | 0.7 | 0.95 | 1.22 | 1.54 | 1.74 | 2.13 | 2.5 |
| | IV-9 | 0.06 | 0.13 | 0.23 | 0.4 | 0.5 | 0.71 | 0.97 | 1.25 | 1.57 | 1.77 | 2.15 | 2.49 |
| Comparative Example | IV-1 | 0.06 | 0.14 | 0.23 | 0.38 | 0.47 | 0.65 | 0.87 | 1.13 | 1.4 | 1.57 | 1.78 | 1.83 |
| | IV-2 | 0.06 | 0.14 | 0.23 | 0.42 | 0.52 | 0.7 | 0.93 | 1.2 | 1.47 | 1.63 | 1.9 | 1.95 |
| | IV-3 | 0.06 | 0.13 | 0.22 | 0.36 | 0.46 | 0.65 | 0.89 | 1.17 | 1.47 | 1.66 | 1.98 | 1.99 |
| | IV-4 | 0.06 | 0.13 | 0.22 | 0.36 | 0.46 | 0.65 | 0.89 | 1.16 | 1.46 | 1.65 | 1.87 | 1.91 |
| | IV-5 | x | x | x | x | x | x | x | x | x | x | x | x |
| | IV-6 | 0.06 | 0.14 | 0.22 | 0.37 | 0.46 | 0.64 | 0.88 | 1.15 | 1.45 | 1.63 | 1.83 | 1.98 |
| | IV-7 | 0.06 | 0.12 | 0.21 | 0.38 | 0.47 | 0.66 | 0.9 | 1.17 | 1.49 | 1.69 | 2.02 | 2.12 |
| | IV-8 | 0.07 | 0.17 | 0.25 | 0.41 | 0.53 | 0.75 | 1.01 | 1.28 | 1.57 | 1.76 | 2.15 | 2.46 |
| | IV-9 | 0.06 | 0.09 | 0.16 | 0.32 | 0.42 | 0.63 | 0.89 | 1.18 | 1.52 | 1.73 | 2.14 | 2.58 |

Note)
x: Unmeasurable

From the results shown in Tables 4 and 5, when compared to the heat-sensitive transfer recording medium of Comparative Example IV-1 not provided with an undercoating layer, it was shown that the heat-sensitive transfer recording media of Examples IV-1 to IV-9 clearly had high transfer sensitivity at a high density part during high-speed printing, and a large cost-cutting effect through reduction of dye used in a dye layer. It was also shown that there were no problems for practical use in adhesion with a dye layer and abnormal transfer during printing.

The heat-sensitive transfer recording medium of Example IV-2 had a content ratio of polyvinyl alcohol and polyvinyl pyrrolidone on mass basis of polyvinyl alcohol/polyvinyl pyrrolidone=8/2, and, possibly because of a low polyvinyl pyrrolidone ratio, the heat-sensitive transfer recording medium resulted in slightly reduced adhesion with a dye layer when compared to the heat-sensitive transfer recording medium of Example IV-1.

The heat-sensitive transfer recording medium of Example IV-3 had a content ratio of polyvinyl alcohol and polyvinyl pyrrolidone on mass basis of polyvinyl alcohol/polyvinyl pyrrolidone=3/7, and, possibly because of a low polyvinyl alcohol ratio, the heat-sensitive transfer recording medium resulted in slightly reduced transfer sensitivity when compared to the heat-sensitive transfer recording medium of Example IV-1.

The heat-sensitive transfer recording medium of Example IV-4 resulted in slightly reduced adhesion with a dye layer when compared to the heat-sensitive transfer recording medium of Example IV-1, possibly because the applied amount of the undercoating layer was less than 0.05 g/m$^2$.

The heat-sensitive transfer recording medium of Example IV-5 resulted in slightly reduced transfer sensitivity when compared to the heat-sensitive transfer recording medium of Example IV-1, possibly because the applied amount of the undercoating layer was more than 0.30 g/m$^2$.

The heat-sensitive transfer recording medium of Example IV-6 had a content ratio of polyvinyl acetal whose glass transition temperature was not lower than 100° C. and polyvinyl butyral whose glass transition temperature was not higher than 75° C. contained in the dye layer on mass basis of polyvinyl acetal/polyvinyl butyral=95/5, and, possibly because of having a slightly low polyvinyl butyral ratio, resulted in slightly reduced transfer sensitivity at a low density part when compared to the heat-sensitive transfer recording medium of Example IV-1. Furthermore, the heat-sensitive transfer recording medium of Example IV-7 had a content ratio of polyvinyl acetal/polyvinyl butyral=98/2, and, possibly because of having a polyvinyl butyral ratio lower than that of the heat-sensitive transfer recording medium of Example IV-6, resulted in slightly reduced transfer sensitivity at a low density part when compared to the heat-sensitive transfer recording medium of Example IV-6.

The heat-sensitive transfer recording medium of Example IV-8 had a content ratio of polyvinyl acetal whose glass transition temperature was not lower than 100° C. and polyvinyl butyral whose glass transition temperature was not higher than 75° C. contained in the dye layer on mass basis of polyvinyl acetal/polyvinyl butyral=50/50, and, possibly because of having slightly high polyvinyl butyral ratio, resulted in slightly high transfer sensitivity at a low density part when compared to the heat-sensitive transfer recording medium of Example IV-1. Furthermore, the heat-sensitive transfer recording medium of Example IV-9 had a content ratio of polyvinyl acetal/polyvinyl butyral=40/60, and, possibly because of having a polyvinyl butyral ratio higher than the heat-sensitive transfer recording medium of Example IV-8, resulted in slightly high transfer sensitivity at a low density part when compared to the heat-sensitive transfer recording medium of Example IV-1. However, slight deformation and elongation of the heat-sensitive transfer recording medium was observed.

On the other hand, as a result of using polyvinyl alcohol whose tensile strength measured based on JIS K 7113 was lower than 8 kg/mm$^2$, the heat-sensitive transfer recording medium of Comparative Example IV-2 resulted in significantly reduced transfer sensitivity when compared to the heat-sensitive transfer recording medium of Example IV-1.

The heat-sensitive transfer recording medium of Comparative Example IV-3 whose dye layer was formed of a dye not containing an anthraquinone compound resulted in significantly reduced transfer sensitivity when compared to the heat-sensitive transfer recording medium of Example IV-1.

The heat-sensitive transfer recording medium of Comparative Example IV-4 in which polyvinyl alcohol having a tensile strength lower than 8 kg/mm$^2$ measured based on JIS K 7113 was used, and whose dye layer was formed of a dye not containing an anthraquinone compound resulted in further reduced transfer sensitivity when compared to the heat-sensitive transfer recording media of Comparative Examples IV-2 and IV-3. When transfer sensitivities were compared between Comparative Example IV-3 in which polyvinyl alcohol having a tensile strength not lower than 8 kg/mm$^2$ measured based on JIS K 7113 was used, and Comparative Example IV-4 in which polyvinyl alcohol having a tensile strength lower than 8 kg/mm$^2$ was used; the difference was small, and it was shown that the effect of tensile strength of polyvinyl alcohol on transfer sensitivity was small when a dye layer formed of a dye not containing an anthraquinone compound was used. From this, it was shown that dramatically high transfer sensitivity was obtained by using polyvinyl alcohol having a tensile strength not lower than 8 kg/mm$^2$ measured based on JIS K 7113, and using a thermal migratory dye containing an anthraquinone compound in a dye layer.

In the heat-sensitive transfer recording medium of Comparative Example IV-5, as a result of applying and then drying an undercoating layer-forming application liquid containing only polyvinyl alcohol to form an undercoating layer; adhesion with a dye layer was reduced and abnormal transfer was observed on the whole surface when compared to the heat-sensitive transfer recording medium of the Example IV-1.

In the heat-sensitive transfer recording medium of Comparative Example IV-6, as a result of applying and then drying an undercoating layer-forming application liquid containing only polyvinyl pyrrolidone to form an undercoating layer; although there were no problems regarding adhesion with a dye layer, transfer sensitivity was significantly reduced when compared to the heat-sensitive transfer recording medium of Example IV-1.

In the heat-sensitive transfer recording medium of Comparative Example IV-7, PVA-117 (manufactured by Kuraray (K.K.)), which is a commercially available product, was used as polyvinyl alcohol for an undercoating layer. Since the tensile strength of the PVA-117 measured based on JIS K 7113 was lower than 8 kg/mm$^2$, the heat-sensitive transfer recording medium of Comparative Example IV-7 resulted in low transfer sensitivity and was not sufficiently satisfactory when compared to the heat-sensitive transfer recording media of Examples IV-1 to IV-9 in which polyvinyl alcohol having a tensile strength not lower than 8 kg/mm$^2$ was used.

In the heat-sensitive transfer recording medium of Comparative Example IV-8, as a result of forming the dye layer by applying and drying a dye layer-forming application liquid containing, as a resin binder, only polyvinyl butylal whose glass transition temperature was not higher than 75° C.; the heat-sensitive transfer recording medium resulted in wrinkles observed on the whole surface of a transfer-target object, although having high transfer sensitivity at a low density part when compared to the heat-sensitive transfer recording medium of Example IV-1.

In the heat-sensitive transfer recording medium of Comparative Example IV-9, as a result of forming the dye layer by applying and drying a dye layer-forming application liquid containing, as a resin binder, only polyvinyl acetal whose glass transition temperature was not lower than 100° C.; the heat-sensitive transfer recording medium resulted in significantly reduced transfer sensitivity at a low density part when compared to the heat-sensitive transfer recording medium of Example IV-1.

(V) Embodiment V

Examples Corresponding to the Heat-Sensitive Transfer Recording Medium V and Comparative Examples Thereof <Production of Base Material with Heat-Resistant Slippage Layer>

A base material with a heat-resistant slippage layer was obtained by using a method similar to the method in Examples corresponding to Embodiment I in (I) above and Comparative Examples thereof.

<Preparation of Polyvinyl Alcohol>

By using a method similar to the method in Examples corresponding to Embodiment I in (I) above and Comparative Examples thereof, polyvinyl alcohol having a degree of saponification of 94 mol % and an average degree of polymerization of 2200, and polyvinyl alcohol having a degree of saponification of 88 mol % and an average degree of polymerization of 2200 were obtained.

<Tensile Strength Measurement of Polyvinyl Alcohol Film>

Tensile strength was measured by using a method similar to the method in Examples corresponding to Embodiment I in (I) above and Comparative Examples thereof. The resulting values were 8.2 kg/mm$^2$ for the polyvinyl alcohol having a degree of saponification of 94 mol % and an average degree of polymerization of 2200, and 6.8 kg/mm$^2$ for the polyvinyl alcohol having a degree of saponification of 88 mol % and an average degree of polymerization of 2200, and 7.4 kg/mm$^2$ for Kuraray Poval PVA-117.

Example V-1

On the adhesion-eased surface of the base material with the heat-resistant slippage layer, an undercoating layer-forming application liquid V-1 having the following composition was applied through gravure coating such that the applied amount after drying was 0.20 g/m$^2$, and the base material was dried at 100° C. for 2 minutes to form an undercoating layer. Then, on the undercoating layer, a dye layer-forming application liquid V-1 having the following composition was applied through gravure coating such that the applied amount after drying was 0.70 g/m$^2$, dried at 90° C. for 1 minute to form a dye layer, and a heat-sensitive transfer recording medium of Example V-1 was obtained.

<Undercoating Layer-Forming Application Liquid V-1>

| | |
|---|---|
| Polyvinyl alcohol (tensile strength: 8.2 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

<Dye Layer-Forming Application Liquid V-1>

| | |
|---|---|
| Nonreactive silicone oil (number average molecular weight: 8000, side-chain polyether modified silicone oil) | 0.1 parts |
| Reactive silicone oil (number average molecular weight: 3000, side-chain diamine modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Example V-2

A heat-sensitive transfer recording medium of Example V-2 was obtained in a manner similar to Example V-1, except for forming an undercoating layer using an undercoating layer-forming application liquid V-2 having the following composition in the heat-sensitive transfer recording medium produced in Example V-1.

<Undercoating Layer-Forming Application Liquid V-2>

| | |
|---|---|
| Polyvinyl alcohol (tensile strength: 8.2 kg/mm$^2$) | 4.0 parts |
| Polyvinyl pyrrolidone (homopolymer of N-vinyl-2-pyrrolidone | 1.0 part |
| Pure water | 57.0 parts |
| Isopropyl alcohol | 38.0 parts |

Example V-3

A heat-sensitive transfer recording medium of Example V-3 was obtained in a manner similar to Example V-1, except for forming an undercoating layer using an undercoating layer-forming application liquid V-3 having the following composition in the heat-sensitive transfer recording medium produced in Example V-1.

<Undercoating Layer-Forming Application Liquid V-3>

| | |
|---|---|
| Polyvinyl alcohol (tensile strength: 8.2 kg/mm$^2$) | 1.5 parts |
| Polyvinyl pyrrolidone (homopolymer of N-vinyl-2-pyrrolidone | 3.5 parts |
| Pure water | 57.0 parts |
| Isopropyl alcohol | 38.0 parts |

Example V-4

A heat-sensitive transfer recording medium of Example V-4 was obtained in a manner similar to Example V-1, except for setting the applied amount of the undercoating layer after drying to 0.03 g/m$^2$ in the heat-sensitive transfer recording medium produced in Example V-1.

Example V-5

A heat-sensitive transfer recording medium of Example V-5 was obtained in a manner similar to Example V-1, except for setting the applied amount of the undercoating layer after drying to 0.40 g/m$^2$ in the heat-sensitive transfer recording medium produced in Example V-1.

Example V-6

A heat-sensitive transfer recording medium of Example V-6 was obtained in a manner similar to Example V-1, except for forming a dye layer using a dye layer-forming application liquid V-2 having the following composition in the heat-sensitive transfer recording medium produced in Example V-1.

<Dye Layer-Forming Application Liquid V-2>

| | |
|---|---|
| Nonreactive silicone oil (number average molecular weight: 8000, both-ends long-chain alkyl modified silicone oil) | 0.1 parts |
| Reactive silicone oil (number average molecular weight: 3000, side-chain diamine modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Example V-7

A heat-sensitive transfer recording medium of Example V-7 was obtained in a manner similar to Example V-1, except for forming a dye layer using a dye layer-forming application liquid V-3 having the following composition in the heat-sensitive transfer recording medium produced in Example V-1.

<Dye Layer-Forming Application Liquid V-3>

| | |
|---|---|
| Nonreactive silicone oil (number average molecular weight: 8000, side-chain polyether modified silicone oil) | 0.1 parts |
| Reactive silicone oil (number average molecular weight: 3000, both-ends amino modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example V-1

A heat-sensitive transfer recording medium of Comparative Example V-1 was obtained in a manner similar to Example V-1, except for not forming an undercoating layer in the heat-sensitive transfer recording medium produced in Example V-1.

Comparative Example V-2

A heat-sensitive transfer recording medium of Comparative Example V-2 was obtained in a manner similar to Example V-1, except for forming an undercoating layer using an undercoating layer-forming application liquid V-4 having the following composition in the heat-sensitive transfer recording medium produced in Example V-1.

<Undercoating Layer-Forming Application Liquid V-4>

| | |
|---|---|
| Polyvinyl alcohol (tensile strength: 6.8 kg/mm$^2$) | 3.0 parts |
| Polyvinyl pyrrolidone (homopolymer of N-vinyl-2-pyrrolidone) | 2.0 parts |
| Pure water | 57.0 parts |
| Isopropyl alcohol | 38.0 parts |

Comparative Example V-3

A heat-sensitive transfer recording medium of Comparative Example V-3 was obtained in a manner similar to Example V-1, except for forming a dye layer using a dye layer-forming application liquid V-4 having the following composition in the heat-sensitive transfer recording medium produced in Example V-1.

<Dye Layer-Forming Application Liquid V-4>

| | |
|---|---|
| Nonreactive silicone oil (number average molecular weight: 8000, side-chain polyether modified silicone oil) | 0.1 parts |
| Reactive silicone oil (number average molecular weight: 3000, side-chain diamine modified silicone oil) | 0.1 parts |
| C.I. Solvent blue 266 (azo dye) | 6.0 parts |
| Polyvinyl acetal | 4.0 parts |
| Toluene | 44.9 parts |
| Methyl ethyl ketone | 44.9 parts |

Comparative Example V-4

A heat-sensitive transfer recording medium of Comparative Example V-4 was obtained in a manner similar to Example V-1, except for forming an undercoating layer using the undercoating layer-forming application liquid V-4 and forming a dye layer using the dye layer-forming application liquid V-4 in the heat-sensitive transfer recording medium produced in Example V-1.

Comparative Example V-5

A heat-sensitive transfer recording medium of Comparative Example V-5 was obtained in a manner similar to Example V-1, except for forming an undercoating layer using an undercoating layer-forming application liquid V-5 having the following composition in the heat-sensitive transfer recording medium produced in Example V-1.

<Undercoating Layer-Forming Application Liquid V-5>

| | |
|---|---|
| Polyvinyl alcohol (tensile strength: 8.2 kg/mm$^2$) | 5.0 parts |
| Pure water | 57.0 parts |
| Isopropyl alcohol | 38.0 parts |

Comparative Example V-6

A heat-sensitive transfer recording medium of Comparative Example V-6 was obtained in a manner similar to Example V-1, except for forming an undercoating layer using an undercoating layer-forming application liquid V-6 having the following composition in the heat-sensitive transfer recording medium produced in Example V-1.

<Undercoating Layer-Forming Application Liquid V-6>

| | |
|---|---|
| Polyvinyl pyrrolidone (homopolymer of N-vinyl-2-pyrrolidone) | 5.0 parts |
| Pure water | 57.0 parts |
| Isopropyl alcohol | 38.0 parts |

Comparative Example V-7

A heat-sensitive transfer recording medium of Comparative Example V-7 was obtained in a manner similar to Example V-1, except for forming an undercoating layer using an undercoating layer-forming application liquid V-7 having the following composition in the heat-sensitive transfer recording medium produced in Example V-1.

<Undercoating Layer-Forming Application Liquid V-7>

| | |
|---|---|
| Polyvinyl alcohol (PVA-117 manufactured by Kuraray (K.K.), tensile strength: 7.4 kg/mm$^2$) | 4.0 parts |
| Polyvinyl pyrrolidone (homopolymer of N-vinyl-2-pyrrolidone) | 1.0 part |
| Pure water | 57.0 parts |
| Isopropyl alcohol | 38.0 parts |

Comparative Example V-8

A heat-sensitive transfer recording medium of Comparative Example V-8 was obtained in a manner similar to Example V-1, except for forming a dye layer using a dye layer-forming application liquid V-5 having the following composition in the heat-sensitive transfer recording medium produced in Example V-1.

<Dye Layer-Forming Application Liquid V-5>

| | |
|---|---|
| Nonreactive silicone oil (number average molecular weight: 8000, side-chain polyether modified silicone oil) | 0.2 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example V-9

A heat-sensitive transfer recording medium of Comparative Example V-9 was obtained in a manner similar to Example V-1, except for forming a dye layer using a dye layer-forming application liquid V-6 having the following composition in the heat-sensitive transfer recording medium produced in Example V-1.

<Dye Layer-Forming Application Liquid V-6>

| | |
|---|---|
| Reactive silicone oil (number average molecular weight: 3000, side-chain diamine modified silicone oil) | 0.2 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example V-10

A heat-sensitive transfer recording medium of Comparative Example V-10 was obtained in a manner similar to Example V-1, except for forming a dye layer using a dye layer-forming application liquid V-7 having the following composition in the heat-sensitive transfer recording medium produced in Example V-1.

<Dye Layer-Forming Application Liquid V-7>

| | |
|---|---|
| Nonreactive silicone oil (number average molecular weight: 8000, side-chain polyether modified silicone oil) | 0.1 parts |
| Nonreactive silicone oil (number average molecular weight: 3000, side-chain polyether modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example V-11

A heat-sensitive transfer recording medium of Comparative Example V-11 was obtained in a manner similar to Example V-1, except for forming a dye layer using a dye layer-forming application liquid V-8 having the following composition in the heat-sensitive transfer recording medium produced in Example V-1.

<Dye Layer-Forming Application Liquid V-8>

| | |
|---|---|
| Reactive silicone oil (number average molecular weight: 8000, side-chain diamine modified silicone oil) | 0.1 parts |
| Reactive silicone oil (number average molecular weight: 3000, side-chain diamine modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

Comparative Example V-12

A heat-sensitive transfer recording medium of Comparative Example V-12 was obtained in a manner similar to Example V-1, except for forming a dye layer using a dye layer-forming application liquid V-9 having the following composition in the heat-sensitive transfer recording medium produced in Example V-1.

<Dye Layer-Forming Application Liquid V-9>

| | |
|---|---|
| Nonreactive silicone oil (number average molecular weight: 7000, side-chain polyether modified silicone oil) | 0.1 parts |
| Reactive silicone oil (number average molecular weight: 4000, side-chain diamine modified silicone oil) | 0.1 parts |
| C.I. Solvent blue 63 (anthraquinone dye) | 6.0 parts |
| Polyvinyl acetal | 4.0 parts |
| Toluene | 44.9 parts |
| Methyl ethyl ketone | 44.9 parts |

<Production of Thermal Transfer Image-Receiving Sheet>

A thermal transfer image-receiving sheet was obtained by using a method similar to the method in Examples corresponding to Embodiment III in (III) above and Comparative Examples thereof.

<Evaluation of Adhesion of Dye Layer>

For each of the heat-sensitive transfer recording media of Examples V-1 to V-7 and Comparative Examples V-1 to V-12, a cellophane tape having a width of 24 mm and a length of 150 mm was adhered to the dye layer of the heat-sensitive transfer recording medium, and then peeled off immediately. Adhesion of the dye layer was evaluated by inspecting whether or not the dye layer had adhered to the cellophane tape side. The results are shown in Table 6.

Evaluation of adhesion of the dye layer was performed using the following criteria.

○: Adhesion of the dye layer is not observed.

Δ: Very slight adhesion of the dye layer is observed.

x: Adhesion of the dye layer is observed on the whole surface.

It should be noted that Δ or better is the level that is not a problem for practical use.

<Print Evaluation>

Print evaluation was conducted through solid-printing with a thermal simulator using the heat-sensitive transfer recording media of Examples V-1 to V-7 and Comparative Examples V-1 to V-12, and measuring the highest reflection. The results are shown in Table 6. It should be noted that the highest reflection density is a value measured with a spectrodensitometer "X-rite 528" manufactured by X-rite Inc.

The following printing conditions were used.

Printing environment: 23° C., 50% RH.

Applied voltage: 29 V.

Line period: 0.7 msec.

Print density: Horizontal scanning of 300 dpi, vertical scanning of 300 dpi.

<Abnormal Transfer Occurring at Intermediate Density Part>

Abnormal transfer occurring at an intermediate density part was evaluated with the following criteria for the heat-sensitive transfer recording media of Examples V-1 to V-7 and Comparative Examples V-1 to V-12. The results are shown in Table 6.

○: Abnormal transfer to the transfer-target object is not observed.

Δ: Very slight abnormal transfer to the transfer-target object is observed.

x: Abnormal transfer to the transfer-target object is observed on the whole surface.

It should be noted that Δ or better is the level that is not a problem for practical use.

<Adhesion Between Aqueous-Receiving Layer and Dye Layer Occurring at Intermediate to High Density Parts>

Adhesion between the aqueous-receiving layer and the dye layer, occurring at intermediate to high density parts, was evaluated with the following criteria for the heat-sensitive transfer recording media of Examples V-1 to V-7 and Comparative Examples V-1 to V-12. The results are shown in Table 6.

○: No traces of adhesion are observed at intermediate to high density parts.

Δ: Traces of adhesion are slightly observed at intermediate to high density parts.

x: Traces of adhesion are clearly observed at intermediate to high density parts.

It should be noted that Δ or better is the level that is not a problem for practical use.

TABLE 6

| | | Highest reflection density | Adhesion of dye layer | Abnormal transfer occurring at intermediate density part | Adhesion occurring at intermediate to high density parts |
|---|---|---|---|---|---|
| Example | V-1 | 2.51 | ○ | ○ | ○ |
| | V-2 | 2.56 | Δ | Δ | ○ |
| | V-3 | 2.41 | ○ | ○ | ○ |
| | V-4 | 2.51 | Δ | Δ | ○ |
| | V-5 | 2.44 | ○ | ○ | ○ |

TABLE 6-continued

| | | Highest reflection density | Adhesion of dye layer | Abnormal transfer occurring at intermediate density part | Adhesion occurring at intermediate to high density parts |
|---|---|---|---|---|---|
| | V-6 | 2.53 | ○ | ○ | Δ |
| | V-7 | 2.46 | ○ | Δ | ○ |
| Comparative Example | V-1 | 1.83 | ○ | ○ | ○ |
| | V-2 | 1.95 | ○ | ○ | ○ |
| | V-3 | 1.99 | ○ | ○ | ○ |
| | V-4 | 1.91 | ○ | ○ | ○ |
| | V-5 | unmeasurable | Δ | x | ○ |
| | V-6 | 1.98 | ○ | ○ | ○ |
| | V-7 | 2.12 | ○ | ○ | ○ |
| | V-8 | 2.52 | Δ | x | ○ |
| | V-9 | 2.51 | ○ | ○ | x |
| | V-10 | 2.15 | ○ | x | ○ |
| | V-11 | 2.52 | ○ | ○ | x |
| | V-12 | 2.10 | ○ | x | x |

From the results shown in Table 6, when compared to the heat-sensitive transfer recording medium of Comparative Example V-1 not provided with an undercoating layer, it was shown that the heat-sensitive transfer recording media of Examples V-1 to V-7 clearly had high transfer sensitivity during high-speed printing, and a large cost-cutting effect through reduction of dye used in a dye layer. In addition, it was shown that there were no problems for practical use regarding adhesion with a dye layer, abnormal transfer occurring at an intermediate density part during printing, and adhesion between the aqueous-receiving layer and the dye layer, occurring at intermediate to high density parts.

The heat-sensitive transfer recording medium of Example V-2 had a content ratio of polyvinyl alcohol and polyvinyl pyrrolidone on mass basis of polyvinyl alcohol/polyvinyl pyrrolidone=8/2, and, possibly because of a low polyvinyl pyrrolidone ratio, the heat-sensitive transfer recording medium resulted in slightly reduced adhesion with a dye layer when compared to the heat-sensitive transfer recording medium of Example V-1.

The heat-sensitive transfer recording medium of Example V-3 had a content ratio of polyvinyl alcohol and polyvinyl pyrrolidone on mass basis of polyvinyl alcohol/polyvinyl pyrrolidone=3/7, and, possibly because of a low polyvinyl alcohol ratio, the heat-sensitive transfer recording medium resulted in slightly reduced transfer sensitivity (highest reflection density) when compared to the heat-sensitive transfer recording medium of Example V-1.

The heat-sensitive transfer recording medium of Example V-4 resulted in slightly reduced adhesion with a dye layer when compared to the heat-sensitive transfer recording medium of Example V-1, possibly because the applied amount of the undercoating layer was less than 0.05 g/m$^2$.

The heat-sensitive transfer recording medium of Example V-5 resulted in slightly reduced transfer sensitivity when compared to the heat-sensitive transfer recording medium of Example V-1, possibly because the applied amount of the undercoating layer was more than 0.30 g/m$^2$.

With the heat-sensitive transfer recording medium of Example V-6, adhesion of a dye layer and an aqueous-receiving layer was slightly observed at intermediate to high density parts when compared to the heat-sensitive transfer recording medium of Example V-1, possibly because a both-ends long-chain alkyl modified silicone oil was used as a nonreactive silicone oil instead of a side-chain polyether modified silicone oil.

With the heat-sensitive transfer recording medium of Example V-7, although adhesion of a dye layer and an aqueous-receiving layer at intermediate to high density parts was prevented from occurring, slight abnormal transfer was observed at an intermediate density part when compared to the heat-sensitive transfer recording medium of Example V-1, possibly because a both-ends amino modified silicone oil was used as a reactive silicone oil instead of a side-chain diamine modified silicone oil.

On the other hand, as a result of using polyvinyl alcohol whose tensile strength measured based on JIS K 7113 was lower than 8 kg/mm$^2$, the heat-sensitive transfer recording medium of Comparative Example V-2 resulted in significantly reduced transfer sensitivity when compared to the heat-sensitive transfer recording medium of Example V-1.

The heat-sensitive transfer recording medium of Comparative Example V-3 whose dye layer was formed of a dye not containing an anthraquinone compound resulted in significantly reduce transfer sensitivity when compared to the heat-sensitive transfer recording medium of Example V-1.

The heat-sensitive transfer recording medium of Comparative Example V-4 in which polyvinyl alcohol having a tensile strength lower than 8 kg/mm$^2$ measured based on JIS K 7113 was used, and whose dye layer was formed of a dye not containing an anthraquinone compound resulted in further reduced transfer sensitivity when compared to the heat-sensitive transfer recording media of Comparative Example V-2 and V-3. When transfer sensitivities were compared between Comparative Example V-3 in which polyvinyl alcohol having a tensile strength not lower than 8 kg/mm$^2$ measured based on JIS K 7113 was used, and Comparative Example V-4 in which polyvinyl alcohol having a tensile strength lower than 8 kg/mm$^2$ was used; the difference was small, and it was shown that the effect of tensile strength of polyvinyl alcohol on transfer sensitivity was small when a dye layer formed of a dye not containing an anthraquinone compound was used. From this, it was shown that dramatically high transfer sensitivity was obtained by using polyvinyl alcohol having a tensile strength not lower than 8 kg/mm$^2$ measured based on JIS K 7113, and using a thermal migratory dye containing an anthraquinone compound in a dye layer.

In the heat-sensitive transfer recording medium of Comparative Example V-5, as a result of applying and then drying an undercoating layer-forming application liquid containing only polyvinyl alcohol to form an undercoating layer, the heat-sensitive transfer recording medium resulted in reduced adhesion with a dye layer and abnormal transfer observed on the whole surface of an intermediate density part when compared to the heat-sensitive transfer recording medium of Example V-1.

In the heat-sensitive transfer recording medium of Comparative Example V-6, as a result of applying and then drying an undercoating layer-forming application liquid containing only polyvinyl pyrrolidone to form an undercoating layer; although there were no problems regarding adhesion with a dye layer, transfer sensitivity was significantly reduced when compared to the heat-sensitive transfer recording medium of Example V-1.

In the heat-sensitive transfer recording medium of Comparative Example V-7, PVA-117 (manufactured by Kuraray (K.K.)), which is a commercially available product, was used as polyvinyl alcohol for an undercoating layer. Since the tensile strength of the PVA-117 measured based on JIS K 7113 was lower than 8 kg/mm$^2$, the heat-sensitive transfer recording medium of Comparative Example V-7 resulted in low transfer sensitivity and was not sufficiently satisfactory when compared to the heat-sensitive transfer recording media of Examples V-1 to V-7 in which polyvinyl alcohol having a tensile strength not lower than 8 kg/mm$^2$ was used.

The heat-sensitive transfer recording medium of Comparative Example V-8 was not able to sufficiently prevent abnormal transfer from occurring at an intermediate density part, since the dye layer did not contain a reactive silicone oil.

The heat-sensitive transfer recording medium of Comparative Example V-9 was not able to sufficiently prevent adhesion of a dye layer and an aqueous-receiving layer at intermediate to high density parts, since the dye layer did not contain a nonreactive silicone oil.

The heat-sensitive transfer recording medium of Comparative Example V-10 was not able to sufficiently prevent abnormal transfer from occurring at an intermediate density part, since the nonreactive silicone oil contained in the dye layer was not reactive, even though its number average molecular weight was 3000.

The heat-sensitive transfer recording medium of Comparative Example V-11 was not able to sufficiently prevent adhesion of a dye layer and an aqueous-receiving layer at intermediate to high density parts, since the reactive silicone oil contained in the dye layer was not nonreactive, even though its number average molecular weight was 8000.

The heat-sensitive transfer recording medium of Comparative Example V-12 resulted in adhesion of a dye layer and an aqueous-receiving layer at intermediate to high density parts, and was not able to sufficiently prevent abnormal transfer from occurring at an intermediate density part, since the dye layer contained a nonreactive silicone oil whose number average molecular weight was smaller than 8000 and a reactive silicone oil whose number average molecular weight was larger than 3000.

INDUSTRIAL APPLICABILITY

Since a heat-sensitive transfer recording medium obtained from the present invention can be used in a sublimation transfer type printer, and enables high speed and high performance printers that easily enable various images to be formed in full color, the heat-sensitive transfer recording medium can be widely used for do-it-yourself printing for digital cameras, cards such as identification cards, output objects for amusement, etc.

DESCRIPTION OF THE REFERENCE CHARACTERS

10 base material
20 undercoating layer
30 dye layer
40 heat-resistant slippage layer

The invention claimed is:

1. A heat-sensitive transfer recording medium comprising a base material, and an undercoating layer and a dye layer sequentially laminated and formed on the base material, wherein:

the undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$; and the dye layer is formed by applying and then drying a dye layer-forming application liquid containing an anthraquinone compound as a thermal migratory dye.

2. The heat-sensitive transfer recording medium according to claim 1, wherein a content ratio of the polyvinyl alcohol and the polyvinyl pyrrolidone in the undercoating layer on mass basis is polyvinyl alcohol/polyvinyl pyrrolidone=4/6 to 7/3.

3. The heat-sensitive transfer recording medium according to claim 1, wherein an applied amount of the undercoating layer after drying, represented by an amount of solid content remaining after the undercoating layer-forming application liquid is applied and dried, is 0.05 to 0.30 g/m$^2$.

4. A heat-sensitive transfer recording medium comprising a base material, a heat-resistant slippage layer formed on one surface of the base material, and an undercoating layer and a dye layer sequentially laminated and formed on the other surface of the base material, wherein:

the undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$;

the dye layer is formed by applying and then drying a dye layer-forming application liquid containing an anthraquinone compound as a thermal migratory dye;

an average value $\alpha$ of surface roughness (Ra) of the heat-resistant slippage layer is 0.05 to 0.50 μm, and an average value $\beta$ of surface roughness (Ra) of the heat-resistant slippage layer after being left still at 150° C. for 10 minutes is 0.00 to 0.80 μm; and a difference between the average value $\alpha$ and the average value $\beta$ is 0.00 to 0.30 μm.

5. The heat-sensitive transfer recording medium according to claim 4, wherein a content ratio of the polyvinyl alcohol and the polyvinyl pyrrolidone in the undercoating layer on mass basis is polyvinyl alcohol/polyvinyl pyrrolidone=4/6 to 7/3.

6. The heat-sensitive transfer recording medium according to claim 4, wherein an applied amount of the undercoating layer after drying, represented by an amount of solid content remaining after the undercoating layer-forming application liquid is applied and dried, is 0.05 to 0.30 g/m$^2$.

7. A heat-sensitive transfer recording medium for forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles, the heat-sensitive transfer recording medium comprising a base material, and an undercoating layer and a dye layer sequentially laminated and formed on the base material, wherein:

the undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$;

the dye layer is formed by applying and then drying a dye layer-forming application liquid containing filler particles and an anthraquinone compound as a thermal migratory dye; and a three-dimensional surface roughness (SRa) of the dye layer is 0.15 to 0.70 μm.

8. The heat-sensitive transfer recording medium according to claim 7, wherein a content ratio of the polyvinyl alcohol and the polyvinyl pyrrolidone in the undercoating layer on mass basis is polyvinyl alcohol/polyvinyl pyrrolidone=4/6 to 7/3.

9. The heat-sensitive transfer recording medium according to claim 7, wherein an applied amount of the undercoating layer after drying, represented by an amount of solid content remaining after the undercoating layer-forming application liquid is applied and dried, is 0.05 to 0.30 g/m$^2$.

10. The heat-sensitive transfer recording medium according to claim 7, wherein a volume average particle diameter of the filler particles is 0.1 to 3.0 μm.

11. A heat-sensitive transfer recording medium comprising a base material, and an undercoating layer and a dye layer sequentially laminated and formed on the base material, wherein:

the undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$; and the dye layer is formed by applying and then drying a dye layer-forming application liquid containing an anthraquinone compound as a thermal migratory dye, and, as resin binders, polyvinyl acetal whose glass transition temperature is not lower than 100° C. and polyvinyl butyral whose glass transition temperature is not higher than 75° C.

12. The heat-sensitive transfer recording medium according to claim 11, wherein a content ratio of the polyvinyl alcohol and the polyvinyl pyrrolidone in the undercoating layer on mass basis is polyvinyl alcohol/polyvinyl pyrrolidone=4/6 to 7/3.

13. The heat-sensitive transfer recording medium according to claim 11, wherein an applied amount of the undercoating layer after drying, represented by an amount of solid content remaining after the undercoating layer-forming application liquid is applied and dried, is 0.05 to 0.30 g/m$^2$.

14. The heat-sensitive transfer recording medium according to claim 11, a content ratio of the polyvinyl acetal whose glass transition temperature is not lower than 100° C. and the polyvinyl butyral whose glass transition temperature is not higher than 75° C. in the dye layer on mass basis is polyvinyl acetal/polyvinyl butyral=50/50 to 97/3.

15. A heat-sensitive transfer recording medium for forming an image through thermal transfer on a thermal transfer image-receiving sheet that has an aqueous-receiving layer containing an aqueous binder and a mold releasing agent and being formed on a base material via an aqueous hallow particle layer containing an aqueous binder and hollow particles, the heat-sensitive transfer recording medium comprising a base material, and an undercoating layer and dye layers sequentially laminated and formed on the base material, wherein:

the undercoating layer is formed by applying and then drying an undercoating layer-forming application liquid containing polyvinyl pyrrolidone and polyvinyl alcohol whose tensile strength measured based on JIS K 7113 is not lower than 8 kg/mm$^2$;

at least one of the dye layers is formed by applying and then drying a dye layer-forming application liquid containing at least two types of modified silicone oils as mold releasing agents, and an anthraquinone compound as a thermal migratory dye; and the modified silicone oils include a nonreactive silicone oil whose number average molecular weight is not smaller than 8000, and a reactive silicone oil whose number average molecular weight is not larger than 3000.

16. The heat-sensitive transfer recording medium according to claim 15, wherein a content ratio of the polyvinyl alcohol and the polyvinyl pyrrolidone in the undercoating layer on mass basis is polyvinyl alcohol/polyvinyl pyrrolidone=4/6 to 7/3.

17. The heat-sensitive transfer recording medium according to claim 15, wherein an applied amount of the undercoating layer after drying, represented by an amount of solid content remaining after the undercoating layer-forming application liquid is applied and dried, is 0.05 to 0.30 g/m$^2$.

18. The heat-sensitive transfer recording medium according to claim 15, wherein the nonreactive silicone oil is a side-chain polyether modified silicone oil, and the reactive silicone oil is a side-chain diamine modified silicone oil.

* * * * *